US012661598B2

(12) United States Patent
Liu et al.

(10) Patent No.: US 12,661,598 B2
(45) Date of Patent: Jun. 23, 2026

(54) SYSTEM AND METHOD FOR TIPPING DURING A LIVESTREAM

(71) Applicant: HYTTO PTE. LTD, Singapore (SG)

(72) Inventors: Dan Liu, Singapore (SG); Jilin Qiu, Singapore (SG)

(73) Assignee: HYTTO PTE. LTD, Singapore (SG)

( * ) Notice: Subject to any disclaimer, the term of this patent is extended or adjusted under 35 U.S.C. 154(b) by 0 days.

(21) Appl. No.: 18/989,459

(22) Filed: Dec. 20, 2024

(65) Prior Publication Data

US 2025/0114719 A1 Apr. 10, 2025

Related U.S. Application Data

(63) Continuation-in-part of application No. 17/934,290, filed on Sep. 22, 2022, which is a continuation-in-part of application No. 17/717,917, filed on Apr. 11, 2022, now Pat. No. 11,938,078, and a continuation-in-part of application No. 17/579,839, filed on Jan. 20, 2022, now Pat. No. 12,171,708.

(51) Int. Cl.
*A61H 19/00* (2006.01)
*A63H 30/04* (2006.01)

(52) U.S. Cl.
CPC ..... *A63H 30/04* (2013.01)

(58) Field of Classification Search
CPC ..... A61H 19/00; A61H 19/30; A61H 19/34; A61H 19/40; A61H 19/44; A61H 2201/5007; A61H 2201/5012; A61F 5/41; G06Q 20/28; G06Q 20/123; G06Q 20/18; G06Q 20/127
See application file for complete search history.

(56) References Cited

U.S. PATENT DOCUMENTS

| | | | |
|---|---|---|---|
| 9,762,515 | B1 | 9/2017 | Olivares |
| 11,134,041 | B1 | 9/2021 | He |
| 2023/0093192 | A1 | 3/2023 | Liu |

*Primary Examiner* — Christine H Matthews
(74) *Attorney, Agent, or Firm* — Keefe IP Law, PLLC

(57) ABSTRACT

An interactive method is disclosed. The interactive method includes configuring an initial association between a tip parameter and an execution parameter of a sex toy, wherein the tip parameter includes one or more tip ranges, and the execution parameter is configured to quantify an action performance of the sex toy, wherein the execution parameter includes at least one of an action type, an action amplitude, an action duration, or an action cycle having at least one of a frequency, a start time, or an end time, and determining whether an actual tip falls into one of the one or more tip ranges in response to receiving the actual tip from at least one viewer device.

20 Claims, 15 Drawing Sheets

| tip parameter | execution parameter of a sex toy | | |
|---|---|---|---|
| tip range | action type | action amplitude/level | action duration |
| 1 to 9 | motion1 | level 1 | 1s |
| 10 to 19 | motion2 | level 2 | 2s |
| 20 to 29 | motion3 | level 3 | 3s |

| tip parameter | execution parameter of a sex toy | | |
|---|---|---|---|
| tip range | action type | action amplitude/level | action duration |
| 1 to 9 | motion1 | level 1 | 1s |
| 10 to 29 | motion2 | level 2 | 2s |
| 30 to 69 | motion3 | level 3 | 3s |

| tip parameter | execution parameter of a sex toy | | |
|---|---|---|---|
| tip range | action type | action amplitude/level | action duration |
| 1 to 9 | motion1 | level 1 | 1s to 10s |
| 10 to 29 | motion2 | level 2 | 1s to 10s |
| 30 to 69 | motion3 | level 3 | 1s to 10s |

SYSTEM AND METHOD FOR TIPPING DURING A LIVESTREAM

CROSS-REFERENCE TO RELATED APPLICATIONS

This application is a continuation-in-part of U.S. patent application Ser. No. 17/934,290 filed Sep. 22, 2022, which is a continuation-in-part of both U.S. patent application Ser. No. 17/717,917 filed Apr. 11, 2022 (issued as U.S. Pat. No. 11,938,078 on Mar. 26, 2024) and also of U.S. patent application Ser. No. 17/579,839 filed Jan. 20, 2022, the entire disclosure of each of which is incorporated herein by reference.

FIELD OF THE INVENTION

The present disclosure generally relates to a system and method for tipping, and more particularly to a system and method for tipping during a livestream.

BACKGROUND OF THE INVENTION

Models, such as pornographic models, often engage in livestreaming erotic videos to viewers as a safe and lucrative way to engage in erotic work. Such livestreaming typically involves tipping of models performing in a livestream by viewers of the livestream.

Such tipping often involves tip ranges. For example, a given tipping range often corresponds to an action of an adult toy used by a model and/or by viewers of the livestream. Tipping within a given range often causes a toy to follow a predetermined action.

Because tipping anywhere within a given range causes the predetermined action, viewers often tip within a relatively lower or lowest end of the range. For example, a fixed tip value associated with a fixed toy action typically will not stimulate an audience to tip a relatively larger amount within a tipping range. This tipping habit by viewers results in a reduction of an amount of tips provided to models, thereby reducing tip income earned by models.

Accordingly, a need in the art exists for an efficient and effective technique to increase tipping by viewers utilizing tipping ranges during livestreaming.

The exemplary disclosed system and method are directed to overcoming one or more of the shortcomings set forth above and/or other deficiencies in existing technology.

SUMMARY OF THE INVENTION

In one exemplary aspect, the present disclosure is directed to an interactive method. The interactive method includes configuring an initial association between a tip parameter and an execution parameter of a sex toy, wherein the tip parameter includes one or more tip ranges, and the execution parameter is configured to quantify an action performance of the sex toy, wherein the execution parameter includes at least one of an action type, an action amplitude, an action duration, or an action cycle having at least one of a frequency, a start time, or an end time, and determining whether an actual tip falls into one of the one or more tip ranges in response to receiving the actual tip from at least one viewer device. The interactive method also includes, if the actual tip falls into the one of the one or more tip ranges, performing a performance optimization configuration for the initial association to obtain an optimized association according to a weight of the actual tip in the one of the one or more tip ranges. The interactive method further includes calculating an optimized action performance of the sex toy based on the optimized association, wherein the optimized action performance is a weight representation of at least one of the action type, the action amplitude, the action duration, and the action cycle corresponding to the one of the one or more tip ranges, generating control instructions according to the optimized action performance, and transmitting the control instructions to at least one of a model device and the at least one viewer device, wherein the model device and the at least one viewer device interact through an online platform. The control instructions are configured to prompt the sex toy that is associated with the model device or the at least one viewer device to respond corresponding to the optimized action performance.

In another aspect, the present disclosure is directed to an interactive system. The interactive system includes at least one module comprising computer-executable code stored in non-volatile memory, and a memory for storing instructions and a processor for executing the instructions. The computer-executable code, when operating on the processor, causes the system to configure an initial association between a tip parameter and an execution parameter of a sex toy, wherein the tip parameter includes one or more tip ranges, and the execution parameter is configured to quantify an action performance of the sex toy, wherein the execution parameter includes at least one of an action type, an action amplitude, an action duration, or an action cycle having at least one of a frequency, a start time, or an end time, and determine whether an actual tip falls into one of the one or more tip ranges in response to receiving the actual tip from at least one viewer device. The computer-executable code, when operating on the processor, also causes the system to, if the actual tip falls into the one of the one or more tip ranges, perform a performance optimization configuration for the initial association to obtain an optimized association according to a weight of the actual tip in the one of the one or more tip ranges. The computer-executable code, when operating on the processor, further causes the system to calculate an optimized action performance of the sex toy based on the optimized association, wherein the optimized action performance is a weight representation of at least one of the action type, the action amplitude, the action duration, and the action cycle corresponding to the one of the one or more tip ranges, generate control instructions according to the optimized action performance, and transmit the control instructions to at least one of a model device and the at least one viewer device, wherein the model device and the at least one viewer device interact through an online platform. The control instructions are configured to prompt the sex toy that is associated with the model device or the at least one viewer device to respond corresponding to the optimized action performance.

DETAILED DESCRIPTION AND INDUSTRIAL APPLICABILITY

Figure 1:
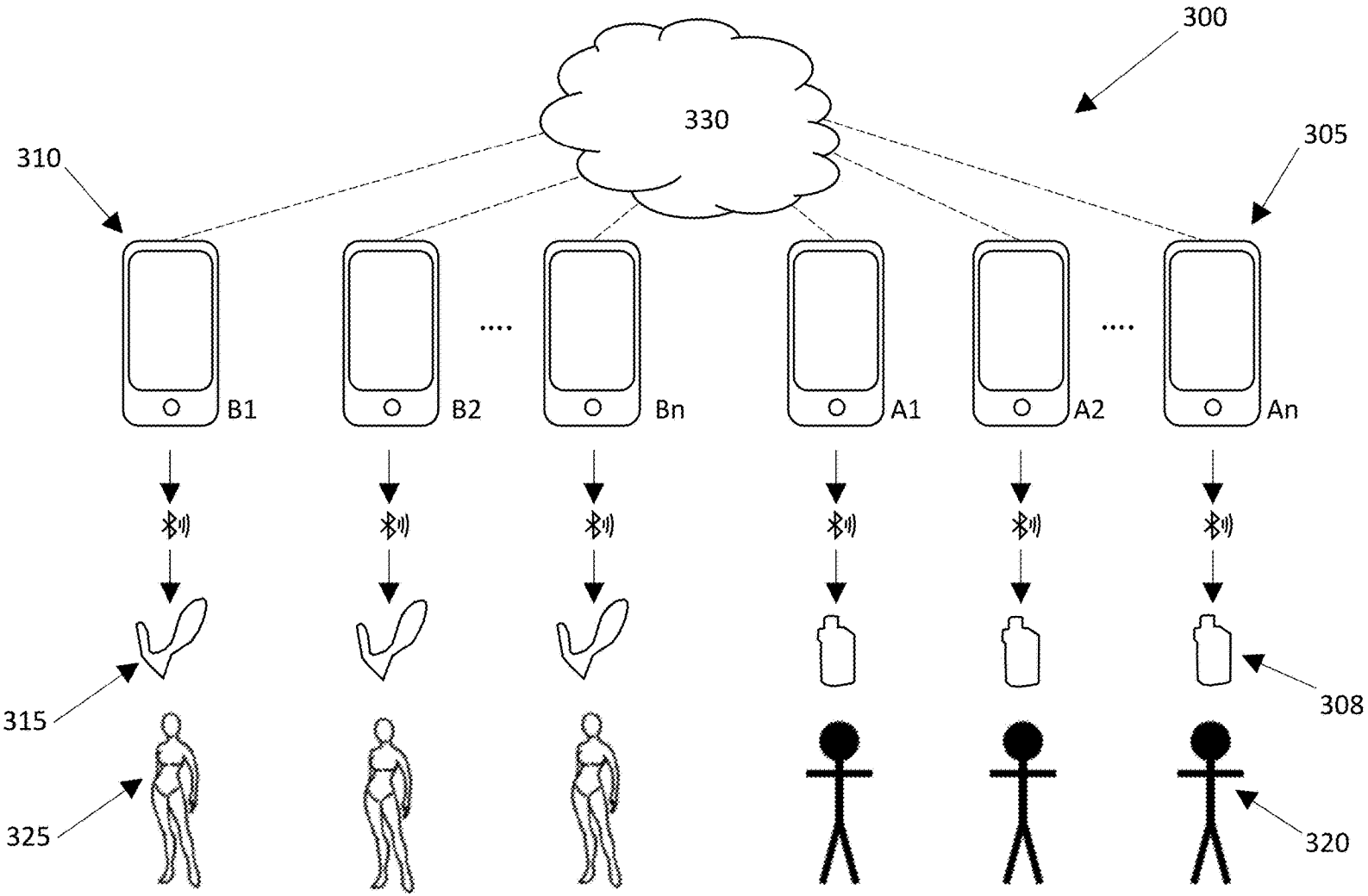
FIG. 1 is a schematic illustration of an exemplary system of the present invention.

FIG. 1 illustrates an exemplary system 300 for providing a live broadcast (e.g., a livestream) including for example controlling devices such as adult devices (e.g., adult toys) as part of the live broadcast. For example, system 300 may include an online platform such as a live broadcast platform. In at least some exemplary embodiments, system 300 may be a system for providing the exemplary disclosed tipping method. For example, the exemplary disclosed system and method may provide for incentivizing viewers to tip at relatively higher portions of the exemplary disclosed tip ranges. Also for example, the exemplary disclosed system and method may have tipping features for bringing relatively greater rewards to viewers of an audience (e.g., relatively longer toy vibrations) when the viewers tip a specific tip amount. In at least some exemplary embodiments, the exemplary disclosed system and method may stimulate viewers of an audience to tip a relatively larger amount within a tip range, thereby bringing relatively greater rewards to a model. Also in at least some exemplary embodiments, the exemplary disclosed system and method may stimulate an audience to tip a relatively larger amount within a tipping range, provide for relatively increased rewards being achieved by an audience based on relatively smaller investments, and/or provide relatively greater rewards to an audience. A reward may be for example an operation of the exemplary disclosed accessory described below at an increased intensity, operation duration, and/or operation frequency (e.g., and/or increases or extensions of any other suitable operation attributes).

As illustrated in FIG. 1, system 300 may include one or more male user devices 305, one or more female user devices 310, one or more male accessories 308, and one or more female accessories 315. For example, system 300 may include a plurality of male user devices 305, a plurality of male accessories 308, a plurality of female user devices 310, and a plurality of female accessories 315. Data such as image data, audio data, and/or control data may be transferred between male user devices 305, male accessories 308, female user devices 310, and female accessories 315.

Returning to FIG. 1, system 300 may include any desired number of male user devices 305 (e.g., A1, A2, . . . . An). Male user device 305 may be any suitable device for interfacing with other components of system 300 such as a computing device (e.g., user interface). For example, male user device 305 may be any suitable user interface for receiving input and/or providing output (e.g., image data) to a male user 320. Male user device 305 may include a camera and a microphone. Male user device 305 may be, for example, a touchscreen device (e.g., of a smartphone, a tablet, a smartboard, and/or any suitable computer device), a wearable device, a computer keyboard and monitor (e.g., desktop or laptop), an audio-based device for entering input and/or receiving output via sound, a tactile-based device for entering input and receiving output based on touch or feel, a dedicated user interface designed to work specifically with other components of system 300, and/or any other suitable user interface (e.g., including components and/or configured to work with components described below regarding FIGS. 17 and 18). For example, male user device 305 may include a touchscreen device of a smartphone or handheld tablet. For example, male user device 305 may include a display (e.g., a computing device display, a touchscreen display, and/or any other suitable type of display) that may provide output, image data, and/or any other desired output or input prompt to a user. For example, the exemplary display may include a graphical user interface to facilitate entry of input by a user and/or receiving output such as image data. An application for example as described herein and/or a web browser may be installed on male user device 305 and utilized by male user 320.

Figure 2:
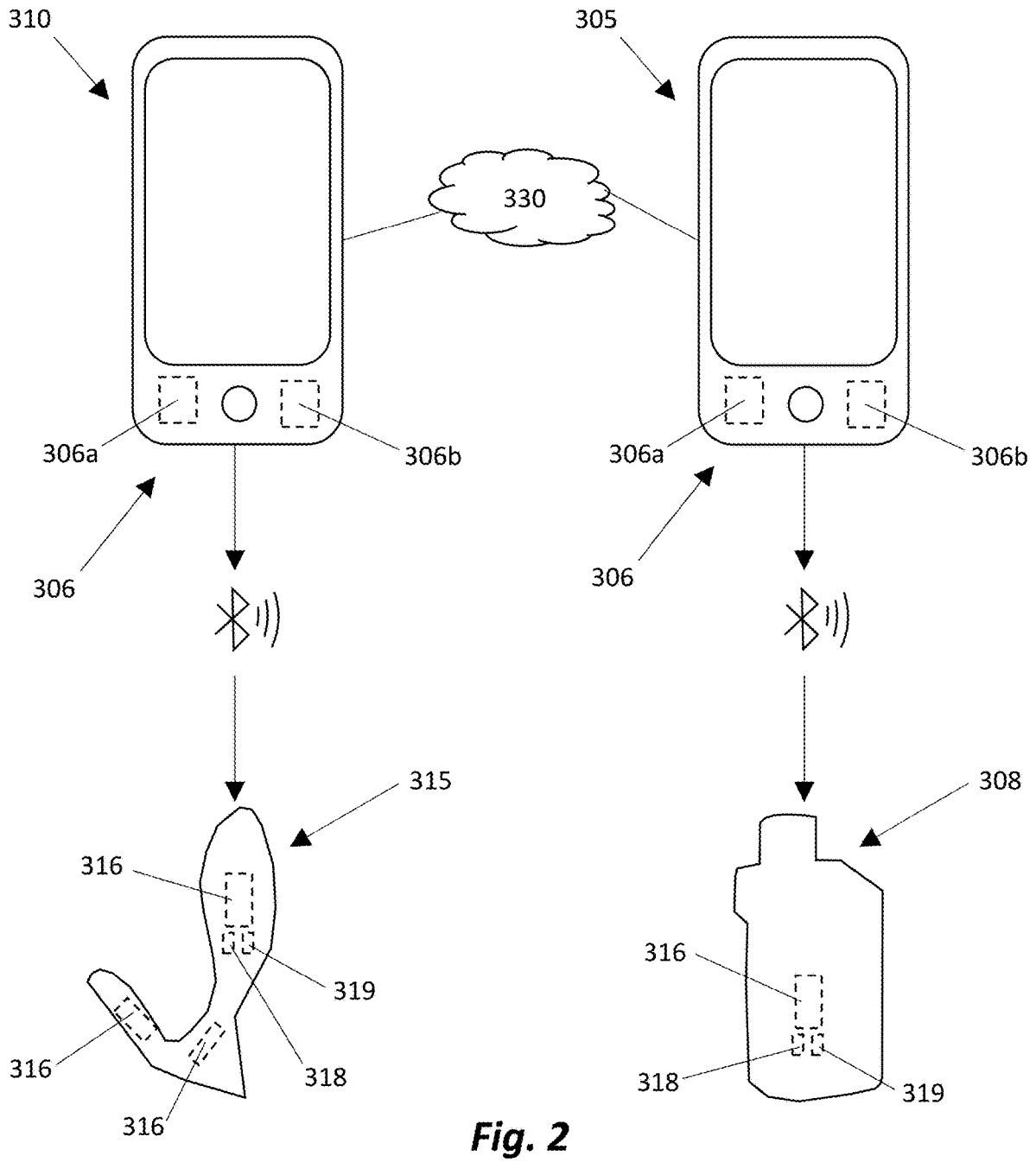
FIG. 2 is schematic illustration of an exemplary accessories of the exemplary disclosed system.

As illustrated in FIG. 2, male user device 305 may include a sensor array 306. In at least some exemplary embodiments, sensor array 306 may include one or more sensors integrated or built into the exemplary disclosed user device (e.g., male user device 305) such as, for example, a mobile phone, a pad, or a wearable device. Sensor array 306 may include any suitable sensors for use with system 300 such as, for example, a location sensor 306*a* and a movement sensor 306*b*. Location sensor 306*a* may include a GPS device, a Galileo device, a GLONASS device, an IRNSS device, a BeiDou device, and/or any other suitable device that may operate with a global navigation system.

Movement sensor 306*b* may include any suitable components for sensing motion (e.g., motion amplitude), velocity, and/or acceleration. Movement sensor 306*b* may include an acceleration sensor. Movement sensor 306*b* may include a gyroscope. For example, movement sensor 306*b* may include a displacement sensor, a velocity sensor, and/or an accelerometer. For example, movement sensor 306*b* may include components such as a servo accelerometer, a piezoelectric accelerometer, a potentiometric accelerometer, and/or a strain gauge accelerometer. Movement sensor 306*b* may include a piezoelectric velocity sensor or any other suitable type of velocity or acceleration sensor.

System 300 may include any desired number of female user devices 310 (e.g., B1, B2, . . . . Bn). Female user device 310 may be similar to male user device 305. For example, female user device 310 may be any suitable user interface for receiving input and/or providing output (e.g., image data) to a female user 325. Female user 325 may operate female user device 310 to record and transfer image (e.g., video) and audio data to one or more male users 320 and/or other female users 325 via a network 330. Additional exemplary disclosed devices and/or users of any desired gender may also be included in the exemplary disclosed system (e.g., a non-binary user and/or a non-binary user device and/or non-binary accessory similar to the examples described herein).

Female accessory 315 may be any suitable accessory for use by female user 325 (e.g., when female user 325 is imaged by female user device 310). For example, female accessory 315 may be a prop that is used by female user 325 while female user 325 is being imaged (e.g., a video or pictures of female user 325 are being recorded and/or transmitted in real-time to be viewed by male user 320 and/or another female user 325). For example, female accessory 315 may be a device used for erotic stimulation (e.g., a sex aid or a "sex toy"). Female accessory 315 may be a sexual stimulation device that may be associated with a given female user 325 and respective female user device 310 of that given female user 325. In at least some exemplary embodiments, female accessory 315 may be a massaging apparatus for human genitalia (e.g., a vibrator). For example, female accessory 315 may be any suitable device for use in a video or pictures recorded by female user device 310, which may be an erotic video or erotic pictures). In at least some exemplary embodiments, female accessory 315 may be a tool or other indicator that may be used in video or pictures recorded by female user device 310 such as a sign providing information such as location or time information, a surveillance tool used by female user 325, and/or any other suitable tool or accessory that may be used while female user device 310 is recording a video or pictures of female user 325. For example, female user 325 may be an erotic model using female accessory 315 that may be an erotic device, a technician or laborer using female accessory 315 that may be a tool or work device specific to a desired application, and/or any other desired role using any suitable female accessory 315.

Female accessory 315 may include one or more driving components such as one or more motors 316. Motor 316 may include an electric motor. Motor 316 may include a servomotor, a stepper motor, a brushless motor, or any other suitable type of motor. Motor 316 may include any suitable vibration motor or haptic motor such as, for example, a mini vibrator motor. Motor 316 may include a low voltage motor. Motor 316 may include a pager motor or a coin vibration motor. Motor 316 may include a linear resonant actuator or an eccentric rotating mass vibration motor. Motor 316 may be a reversible electric motor (e.g., a reversible electric motor). Motor 316 may be a unidirectional motor (e.g., a one-way motor). Motor 316 may be powered by any suitable power source, such as a battery (e.g., a nickel-metal hydride battery, a lithium-ion battery, an ultracapacitor battery, a lead-acid battery, and/or a nickel cadmium battery), an electric power source (e.g., a transformer connected to a plug that may plug into an outlet), and/or any other suitable energy source. Female accessory 315 may include a controller 319 that may be any suitable computing device for controlling an operation of motor 316 and a communication device 318. Controller 319 may, for example, include components similar to the components described below regarding FIG. 17. Controller 319 may include for example a processor (e.g., micro-processing logic control device) or board components. Controller 319 may control one or more motors 316 based on input data and/or commands (e.g., control commands) received from male user device 305 and/or female user device 310 via a network 330 and/or communication device 318 (e.g., transferred directly to communication device 318 by any suitable component of system 300). Motor 316 may be controlled by controller 319 to vibrate female accessory 315 at a desired level or strength, perform a suction operation at a desired level or strength using female accessory 315 (e.g., using female accessory 315 as a suction device), rotate or swing female accessory 315 at a desired speed or amount, contract or expand female accessory 315 by a desired amount, cause female accessory 315 to perform an inhalation action, and/or cause female accessory 315 to perform any other suitable action or function.

In at least some exemplary embodiments, motor 316 may be or may include a thermal device such as a heater (e.g., or a cooler or any other suitable thermal device). Alternatively for example, a heater unit and the exemplary disclosed motor may be separately provided (e.g., installed) in the exemplary disclosed adult toy. In at least some exemplary embodiments, motor 316 may include an electric heating device such as an electric resistance heating device. Motor 316 may include a polyimide heater, a silicone rubber heater, and/or a resistive wire heater. Motor 316 may be controlled by controller 319 to heat or emit heat or warmth from female accessory 315. For example, motor 316 may cause a temperature variation of female accessory 315.

Returning to FIG. 2, male accessory 308 may include components generally similar to female accessory 315 and may operate generally similarly to female accessory 315. Male accessory 308 may be a sexual stimulation device that may be associated with a given male user 320 (e.g., a viewer of one or more female users 325 and/or male users 320; or a male model) and respective male user device 305 (e.g., a viewer device) of that given male user 320.

Network 330 may be any suitable communication network over which data may be transferred between one or more male user devices 305, one or more male accessories 308, one or more female user devices 310, and/or one or more female accessories 315. Network 330 may be the internet, a LAN (e.g., via Ethernet LAN), a WAN, a WiFi network, or any other suitable network. Network 330 may be similar to WAN 201 described below. The components of system 300 may also be directly connected (e.g., by wire, cable, USB connection, and/or any other suitable electromechanical connection) to each other and/or connected via network 330. For example, components of system 300 may wirelessly transmit data by any suitable technique such as, e.g., wirelessly transmitting data via 4G LTE networks (e.g., or 5G networks) or any other suitable data transmission technique for example via network communication. Components of system 300 may transfer data via the exemplary techniques described below regarding FIG. 18. Male user devices 305, male accessories 308, female user devices 310, and/or female accessories 315 may include any suitable communication components for communicating with other components of system 300 using for example the communication techniques described above. For example, male user devices 305 and female user devices 310 may include integrally formed communication devices (e.g., smartphone components), and male accessories 308 and female accessories 315 may each include communication device 318 that may communicate using any of the exemplary disclosed communication techniques.

In at least some exemplary embodiments, a given female accessory 315 may communicate with a given female user device 310 (e.g., a paired female user device 310) via any suitable short distance communication technique. For example, female accessories 315 (e.g., via communication device 318) and female user devices 310 may communicate via Wifi, Bluetooth, ZigBee, NFC, IrDA, and/or any other suitable short distance technique. Female accessory 315 may be an adult toy that may be connected with female user device 310 through short distance wireless communication. An application (e.g., operating using the exemplary disclosed modules) may be installed on female user device 310, the application and female user device 310 being configured to send commands to female accessory 315 to drive (e.g., actuate) female accessory 315. Male accessory 308 may communicate with male user device 305 similarly to the communication of female accessory 315 and female user device 310 described above.

System 300 may include one or modules for performing the exemplary disclosed operations such as, for example, the exemplary disclosed monitoring module, determination module, application module, analysis module, and/or display module for example as described below. The one or more modules may include an accessory control module for controlling male accessory 308 and female accessory 315. The one or more modules may be stored and operated by any suitable components of system 300 (e.g., including processor components) such as, for example, network 330, male user device 305, male accessory 308, female user device 310, female accessory 315, and/or any other suitable component of system 300. For example, system 300 may include one or more modules having computer-executable code stored in non-volatile memory. System 300 may also include one or more storages (e.g., buffer storages) that may include components similar to the exemplary disclosed computing device and network components described below regarding FIGS. 17 and 18. For example, the exemplary disclosed buffer storage may include components similar to the exemplary storage medium and RAM described below regarding FIG. 17. The exemplary disclosed buffer storage may be implemented in software and/or a fixed memory location in hardware of system 300. The exemplary disclosed buffer storage (e.g., a data buffer) may store data temporarily during an operation of system 300.

The one or more exemplary disclosed modules may include software modules running on model equipment. The software modules may include a smart panel (e.g., as described below), game plug-ins, and/or toy control plug-ins (e.g., for the exemplary disclosed toys) that may assist models in live broadcasting.

Figure 3:
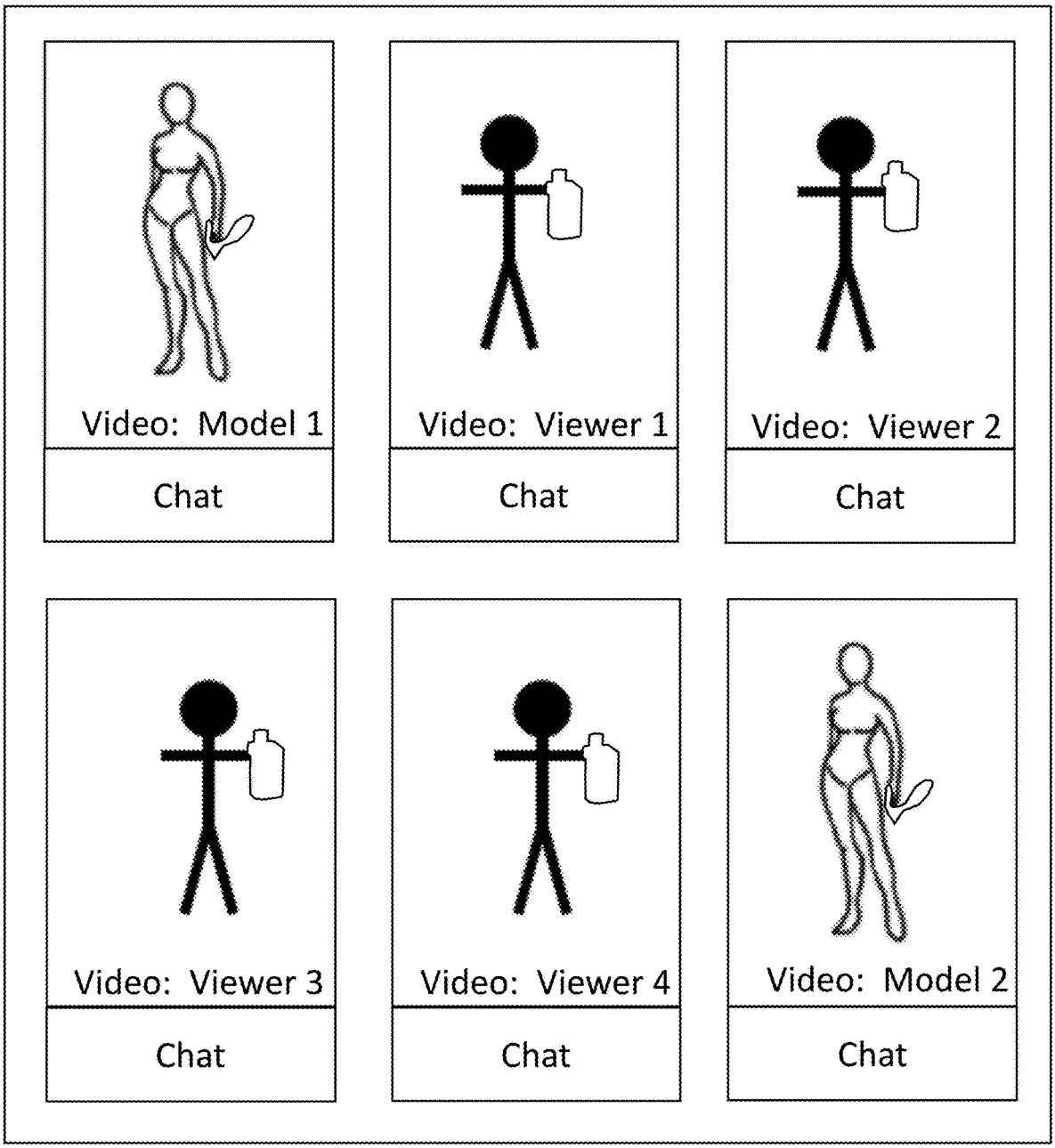
FIG. 3 is a schematic illustration of an exemplary embodiment of the exemplary disclosed system.

The one or more exemplary disclosed modules may also provide a chat room interface via one or more male user devices 305 and/or one or more female user devices 310 for use by male users 320 and female users 325. For example, video display of female user 325, one or more male users 320, and/or and a chat or messaging app (e.g., any suitable chat communication or messaging app such as, for example, text, voice, and/or video chat boxes) may be displayed to each male user 320 via male user device 305 and to each female user 325 via female user device 310. One or more male users 320 and one or more female users 325 may thereby view and chat (e.g., text, voice, and/or video chat) with each other via the one or more exemplary disclosed modules via respective male user devices 305 and female user devices 310. Male users 320 and female users 325 may thereby view, interact with, and/or chat (e.g., text, voice, and/or video chat) with other female users 325 and/or other male users 320 (e.g., and/or any other users of an gender such as non-binary users as described above or any other gender). For example, multiple text, voice, and/or video chat boxes including a plurality of male users 320 (e.g., viewers or models each having one or more male accessories 308) and/or a plurality of female users 325 (e.g., viewers or models each having one or more female accessories 315) may be displayed to each male user 320 and each female user 325 via respective male user devices 305 and female user devices 310. Male users 320 and female users 325 may thereby view and interact with other male users 320 and female users 325 that may each have one or more respective accessories (e.g., respective male accessories 308 and female accessories 315). FIG. 3 schematically illustrates an exemplary embodiment of the exemplary disclosed chat room that may be displayed to male user 320 via male user device 305 and/or to female user 325 via female user device 310.

Figure 4:
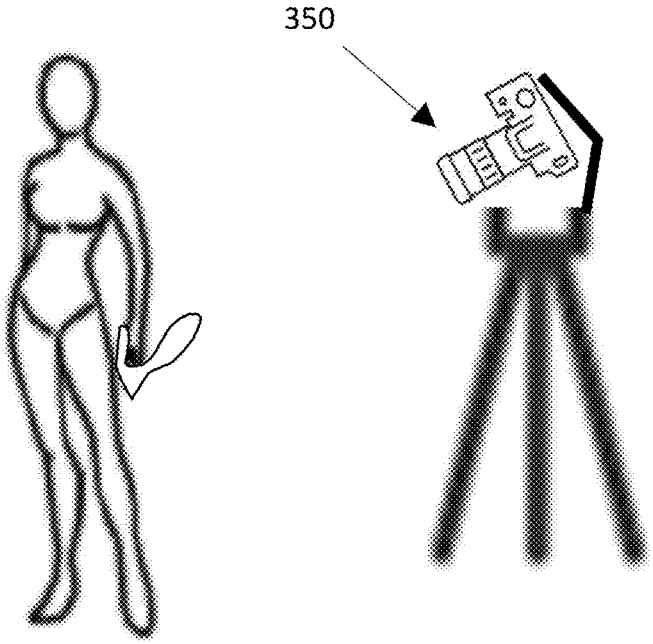
FIG. 4 is a schematic illustration of an exemplary embodiment of the exemplary disclosed system.

In at least some exemplary embodiments and as illustrated in FIG. 4, system 300 may further include an imaging device 350. Imaging device 350 may be used directly and/or indirectly to provide data to be used in an operation of system 300. For example, imaging device 350 may be a camera that may be used to obtain user input (e.g., data of gesturing images made by the user) by any suitable imaging technique (e.g., for example as described herein).

Imaging device 350 may be any suitable imaging device such as a camera. For example, imaging device 350 may be any suitable video camera such as a digital video camera, a webcam, and/or any other suitable camera for recording visual data (e.g., recording a video or taking pictures) and/or image recognition. Imaging device 350 may be a 3D camera. Imaging device 350 may be a headset that may be worn by a user (e.g., male user 320 or female user 325). Imaging device 350 may be a spatial computing device (e.g., a spatial computer). Imaging device 350 may utilize any suitable spatial computing features and/or techniques (e.g., similar to Apple Vision Pro). Imaging device 350 may be for example a three-dimensional video sensor or camera. One or more imaging devices 350 may include a plurality of cameras or a single camera configured to collect three-dimensional image data. In at least some exemplary embodiments, imaging device 350 may be a stereoscopic camera and/or any other suitable device for stereo photography, stereo videography, and/or stereoscopic vision. Imaging device 350 may be substantially entirely integrated into the exemplary disclosed user devices or may be a stand-alone device. In at least some exemplary embodiments, imaging device 350 may be a smartphone or tablet camera. Imaging device 350 may provide data to an exemplary image recognition module of system 300. Imaging device 350 may include one or more actuators that may adjust a position of imaging device 350 based on an operation of system 300 (imaging device 350 may also include a support or stand for supporting imaging device 350). The actuators may be for example one or more external actuators disposed at an exterior of imaging device 350 and/or one or more integrated actuators that are completely or partially integrated into imaging device 350 (e.g., disposed and/or integrated within an interior of imaging device 350). In at least some exemplary embodiments, the actuators may be internally integrated into imaging device 350 and may turn optical components and/or move lenses of imaging device 350 within a housing of imaging device 350 to zoom in and out at different features or points within a variable field of view of imaging device 350 (e.g., zoom in and out on points or features of a user and/or exemplary disclosed accessories). The actuator may also be one or more external and/or internally-integrated mechanical actuators configured to mechanically turn imaging device 350 and move lenses of imaging device 350 to focus in and out at desired objects (e.g., points and/or features of a user and/or an accessory). System 300 may also include an image recognition module that may perform feature detection and matching to allow for matching and comparison of features imaged by imaging device 350. For example, imaging device 350 may find predetermined features that may correspond to two-dimensional and/or three-dimensional surfaces and/or contours of an object within a field of view of imaging device 350. Also for example, any suitable technique may be used to identify features (e.g., spatial data) of a viewed object (e.g., features of a user and/or accessory) and to match those imaged features to predetermined features provided by system 300 (e.g., or provided by a user). Also for example, optical character recognition of text and/or markings located on a viewed object may be performed. For example, spatial data and/or other data may be determined that may be matched to predetermined data provided by system 300 (e.g., predetermined shapes, colors, text, contours, and other features). For example, the spatial data and/or other data may include data defining points (e.g., or contours) of a user and/or accessory based on an actual image of an object (e.g., the exemplary disclosed accessories) imaged by imaging device 350. For example, spatial and/or data based on viewing an object may be used to match that data to predetermined data to identify points or features of an object being viewed. Any suitable techniques for recognizing objects and/or determining spatial and/or other data of a viewed object may be utilized by system 300 for image recognition via imaging device 350.

The exemplary disclosed system and method may be used in any suitable application for providing tipping during a live broadcast. The exemplary disclosed system and method may be used in any suitable application involving a model livestreaming a video to an audience for tips. For example, the exemplary disclosed system and method may be used in any suitable application for providing a livestream erotic broadcast and receiving tipping during the broadcast.

Figure 5A:
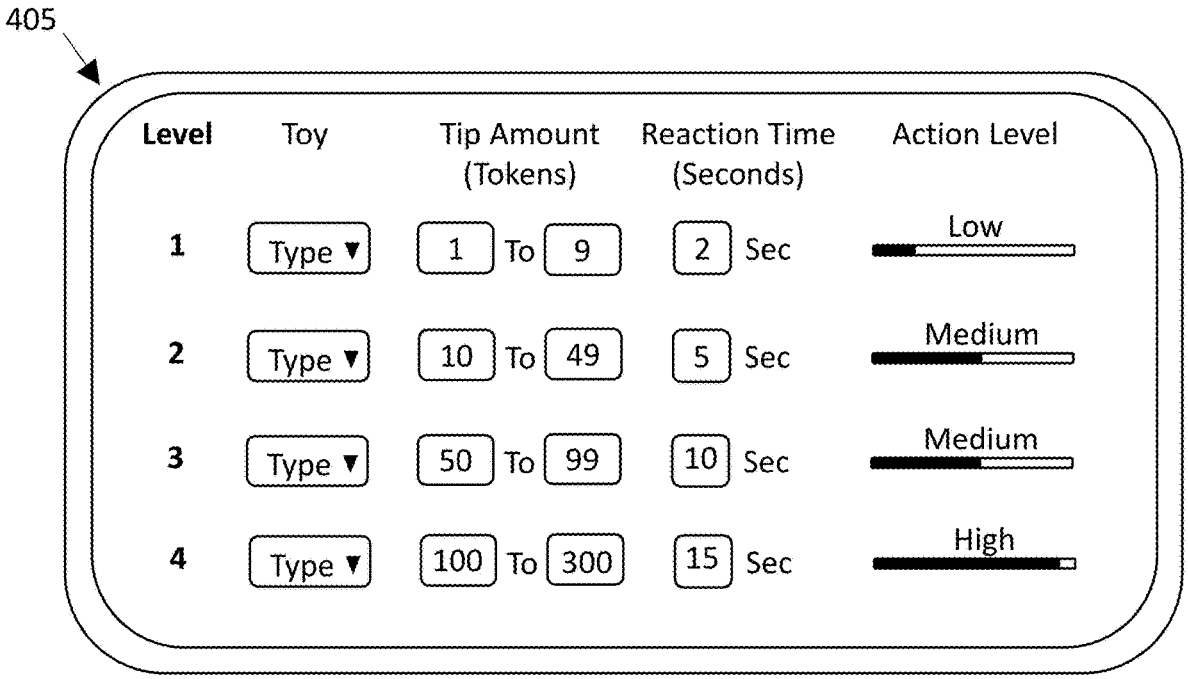
FIG. 5A is a schematic illustration of an exemplary embodiment of the exemplary disclosed system.

In at least some exemplary embodiments and for example as illustrated in FIG. 5A, graphical elements provided by system 300 may be displayed on a graphical user interface such as a GUI 405 on a display or touchscreen of the exemplary disclosed user device to the user (e.g., or a spatial computing interface such as for example similar to Apple Vision Pro). GUI 405 may display the exemplary disclosed live broadcast and/or data and/or elements associated with the live broadcast (e.g., input data, output data, control elements, graphical elements, information, and/or any other suitable data and/or objects) to one or more viewers and/or models (e.g., one or more female users 325 and/or male users 320) via one or more exemplary disclosed user devices (e.g., one or more female user devices 310 and/or one or more male user devices 305).

Figures 5B, 5C:
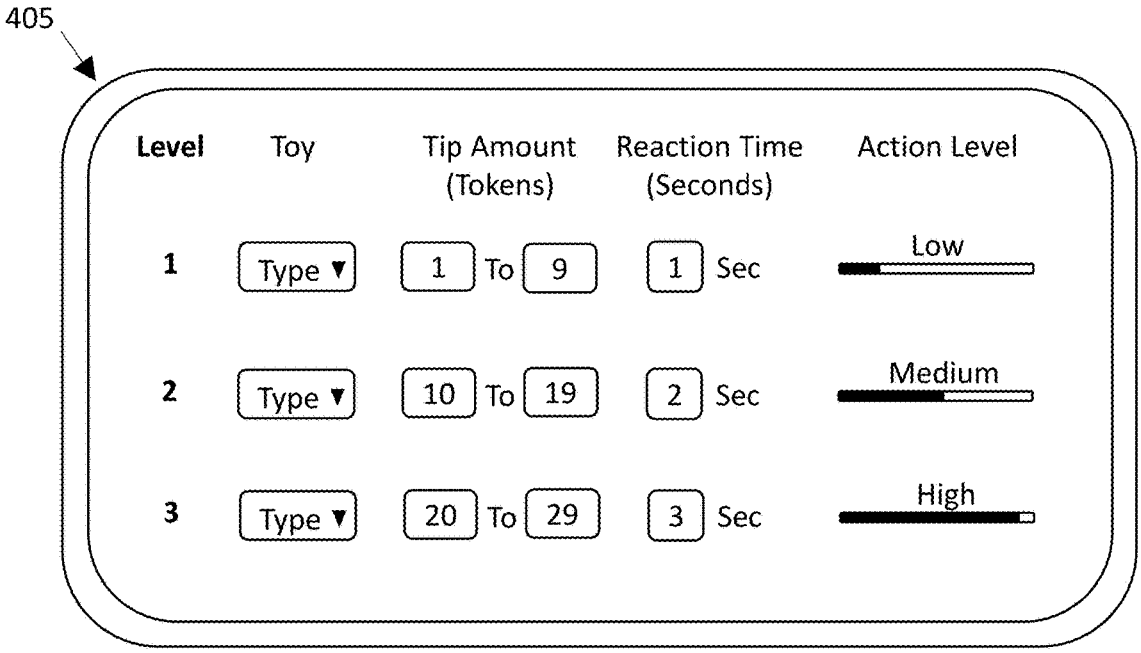
FIG. 5B is a schematic illustration of an exemplary embodiment of the exemplary disclosed system.
FIG. 5C is an illustration of exemplary tip ranges of the exemplary disclosed system.

FIGS. 5A, 5B, and 5C illustrate exemplary initial associations of the exemplary disclosed system and method. For example, a tip range may correspond to a toy action (e.g., at a given intensity level, duration, and/or actuation level such as vibration level). For example in an initial association of a tip range, tipping values in a tipping range may have a many-to-one relationship with a toy action (e.g., an action of male accessory 308 and/or female accessory 315). An initial association may be between a tip parameter and an execution parameter of an accessory (e.g., an adult accessory such as a sex toy, for example male accessory 308 and/or female accessory 315).

The exemplary disclosed system and method may configure an initial association between the exemplary disclosed tip parameter and the exemplary disclosed execution parameter of an accessory (e.g., sex toy) based on predetermined algorithms of system 300, user input via the exemplary disclosed user device (e.g., input entered by a model via male user device 305 or female user device 310), an AI engine using the exemplary disclosed artificial intelligence operations, and/or any other suitable technique. The exemplary disclosed tip parameter may include one or more tip ranges for example as illustrated in FIGS. 5A through 5C (e.g., a range of 1 to 9 tokens or 50 to 99 tokens as illustrated in FIG. 5A, or a range of 10 to 19 tokens as illustrated in FIGS. 5B and 5C). The exemplary disclosed tip ranges may be quantified using any suitable unit of value such as, for example, tokens (e.g., that may be purchased using any item of value), any type of national, regional, or crypto currency, and/or any other suitable measure of value.

The exemplary disclosed execution parameter may be configured to quantify an action performance of the exemplary disclosed accessory such as an adult toy. The execution parameter may include one or more of an action type of an accessory (e.g., vibration, suction, rotation or swinging, contraction and/or expansion, inhalation, temperature change such as heating and/or cooling, and/or any other suitable type of action of an accessory including for example the actions described herein), an amplitude or intensity level of an operation of the accessory (e.g., low, medium, high, ultra high, and/or any other desired level), a duration (e.g., a time period) of operation of the accessory, an action cycle (e.g., frequency, one or more start times, and/or one or more end times), and/or any other desired attribute of an operation of an accessory such as a sex toy. For example, the exemplary disclosed execution parameter may be vibration (e.g., from a "type" pull-down menu) for 10 seconds at a medium level as illustrated in FIG. 5A, or a "motion3" of suction (e.g., from a "type" pull-down menu) for 3 seconds at a high level as illustrated in FIGS. 5B and 5C.

The action performance may be quantified based on the execution parameter based on any suitable technique. For example, the action performance may be quantified as a cumulative value of each parameter (e.g., the exemplary disclosed parameters described above) contained in the execution parameter. For example, the action performance may be quantified as an action type multiplied by an action amplitude multiplied by an action duration multiplied by an action cycle. For example, action performance=(action type)*(action amplitude)*(action duration)*(action cycle).

The exemplary disclosed system and method may determine whether a tip (e.g., an actual tip received from at least one viewer device such as male user device 305 or female user device 310) falls into one of the one or more exemplary disclosed tip ranges. For example, the exemplary disclosed system and method may determine whether a tip falls into one of the exemplary disclosed tip ranges of FIGS. 5A through 5C (e.g., 50 to 99 tokens, or 20 to 29 tokens).

If a tip falls into one of the exemplary disclosed tip ranges, the exemplary disclosed system and method may perform a performance optimization configuration for the exemplary disclosed initial association to obtain an optimized association according to the weight of the actual tip in the tip range (e.g., according to where in the tip range the actual tip falls). For example, system 300 may calculate a weight of the actual tip in the tip range based on where between a maximum value and a minimum value (e.g., determined by system 300) the actual tip falls. The exemplary disclosed performance optimization configuration for the initial association may include multiplexing, geometric gain, random interleaving of at least one parameter contained in the execution parameter, and/or any other suitable techniques. In at least some exemplary embodiments, obtaining the exemplary disclosed optimized association according to the weight of the actual tip in a tip range by system 300 may include at least one of multiplexing, geometric gain, or random interleaving. For example, the exemplary disclosed performance optimization configuration may include combining a plurality of the exemplary disclosed parameters of the execution parameter described above. Also for example, the exemplary disclosed performance optimization configuration may include random interleaving of at least one of action type, action amplitude, action duration, action cycle, and/or any other suitable parameter of the execution parameter. In at least some exemplary embodiments, a reuse action cycle from 1 cycle to 10 cycles may be performed, a geometric gain duration from 1s to 10s may be performed, and/or random interleaving of the relation between the action duration and the tip range may be performed. The exemplary disclosed performance optimization configuration for the exemplary disclosed initial association may thereby obtain an optimized association according to the weight of the actual tip in the tip range for example as described herein.

In at least some exemplary embodiments, system 300 may obtain the minimum value of the exemplary disclosed tip range and include the minimum value as a parameter in the exemplary disclosed execution parameter. System 300 may reuse the parameter of the minimum value of the exemplary disclosed tip range to obtain the exemplary disclosed optimized association according to the exemplary disclosed weight of the actual tip in the exemplary disclosed tip range. System 300 may correlate a number of reuses of the parameter of the minimum value with the exemplary disclosed weight.

The exemplary disclosed system and method may calculate an optimized action performance of the sex toy based on the optimized association. The optimized action performance may be a weight representation of at least one parameter of the execution parameter. For example, the optimized action performance may be a weight representation of the exemplary disclosed action type, action amplitude, action duration, and/or action cycle for example as described above corresponding to the tip range. As one example of the optimized action performance being a weight representation of at least one execution parameter, the larger the weight may be, then the larger the value corresponding to the execution parameter may be.

The exemplary disclosed system and method may generate control instructions according to the exemplary disclosed optimized action performance. In at least some exemplary embodiments, the optimized action performance may comprise a new execution parameter of the exemplary disclosed sex toy (e.g., male accessory 308 or female accessory 315).

The exemplary disclosed system and method may transmit the exemplary disclosed control instructions to at least one of a model device (e.g., male user device 305 or female user device 310) and the viewer device (e.g., male user device 305 or female user device 310). The model device and the viewer device may interact through an online platform for example as described above regarding system 300. The control instructions may be configured to prompt an accessory (e.g., male accessory 308 or female accessory 315) associated with the model device and the viewer device (e.g., audience device) to respond corresponding to the exemplary disclosed optimized action performance.

In at least some exemplary embodiments, system 300 may calculate (e.g., determine) an initial action performance of the exemplary disclosed sex toy based on the actual tip and the exemplary disclosed initial association between the exemplary disclosed tip parameter and the exemplary disclosed execution parameter of the sex toy. The exemplary disclosed optimized action performance of the sex toy may be higher than the initial action performance of the sex toy (e.g., based on the exemplary disclosed performance optimization configuration). For example, returning to FIGS. 5B and 5C, an initial association between the exemplary disclosed tip parameter and the exemplary disclosed execution parameter of the sex toy may be: a tip parameter of 1 to 9 tokens that corresponds to an execution parameter of the sex toy of motion1 (e.g., a given action type such as vibration) at "Level 1" (e.g., a given action amplitude such as low) for an action duration such as 1 second; a tip parameter of 10 to 19 tokens that corresponds to an execution parameter of the sex toy of motion2 (e.g., a given action type such as vibration) at "Level 2" (e.g., a given action amplitude such as medium) for an action duration such as 2 seconds; and a tip parameter of 20 to 29 tokens that corresponds to an execution parameter of the sex toy of motion3 (e.g., a given action type such as vibration) at "Level 3" (e.g., a given action amplitude such as high) for an action duration such as 3 seconds. Accordingly based on the initial association for this example, any tip between 1 and 9 tokens may result in an initial action performance of the sex toy of "Level 1" described above (e.g., that is the quantified initial performance of the sex toy is 1 level*1 second=1), any tip between 10 and 19 tokens may result in an initial action performance of the sex toy of "Level 2" described above (e.g., that is the quantified initial performance of the sex toy is 2 level*2 seconds=4), and any tip between 20 and 29 tokens may result in an initial action performance of the sex toy of "Level 3" described above (e.g., that is the quantified initial performance of the sex toy is 3 level*3 seconds=9). In contrast, when the optimized action performance of the sex toy in this example is calculated based on an exemplary disclosed optimized association (e.g., obtained based on the exemplary disclosed multiplexing, geometric gain, or random interleaving), the optimized action performance of the sex toy may be higher than the initial action performance described above. For example, the optimized action performance may increase in duration for a tip between 1 and 9 tokens (e.g., that is the quantified initial performance of the sex toy is 1 level*1.2 seconds=1.2; or 1 level*1.9 seconds=1.9) to incentivize users to tip within a higher portion of the range, as the duration of the optimized action performance (e.g., 1.2 seconds to 1.9 seconds) would be higher than the initial action performance of 1 second. Similar increases may be made in action amplitude (e.g., an action amplitude of low-medium that may be higher than the initial action performance of low), action type (e.g., a more desirable action type may be provided in the optimized action performance), and/or action cycle. Also for example, the optimized action performance may include sequential iterations corresponding to the single iteration of the initial action performance (e.g., whereas the initial action performance of Level 3 would be motion3 at an amplitude of level 3 for 3 seconds for any tip between 20 and 29 tokens, while the optimized action performance may be a plurality of sequential iterations of motion3 at level 3 for up to 3 seconds, thereby providing an optimized action performance that may be higher than the initial action performance). For example, if a number of times of sequential iterations is 2, then the quantified optimized performance of the sex toy is 3 level*3 seconds*2 times=18. In at least some exemplary embodiments, the increased optimized action performance for a given level (e.g., Level 1) may be higher than the initial action performance for that given level (e.g., Level 1), but not higher than the initial action performance for the next higher level (e.g., Level 2), because the tip parameter for the next higher level may be higher than that corresponding to the highest end of the tip parameter of the lower range (e.g., Level 1). The optimized action performance for Level 2 and Level 3 in this example may similarly be higher than the respective initial action performances for Level 2 and Level 3 described above.

In at least some exemplary embodiments, system 300 may configure at least one target tip range. The target tip range may be a portion of a tip range, a substantially entire tip range, or a tip range including portions of different tip ranges. System 300 may configure an association between the target tip range and the exemplary disclosed optimized association. When the actual tip received falls into the target tip range, system 300 may perform the performance optimization configuration for the initial association to obtain the optimized association according to the weight of the actual tip in the target tip range.

In at least some exemplary embodiments, system 300 may configure a control element (e.g., similar to as described below regarding FIGS. 7B, 10, 11, and/or 12A) associated with the actual tip. System 300 may select a tip value from the exemplary disclosed target tip range described above as the actual tip in response to a triggering of the control element. The tip value may be a preset value or provided by system 300 as a random value.

In at least some exemplary embodiments, an audience's tipping input may remain unsplit (e.g., not split), while a number of rewards (e.g., an action of the exemplary disclosed adult toy) may increase. A reward may be for example an operation of one or more exemplary disclosed accessories (e.g., one or more male accessories and/or female accessories 315) at an increased intensity, operation duration, and/or operation frequency (e.g., and/or any other suitable operation attributes for example as described herein). In at least some exemplary embodiments, when the audience tips the model (e.g., when a viewer tips the model using male user device 305 or female user device 310), one tip may receive one reward based on the exemplary disclosed initial association (e.g., as illustrated in FIGS. 5A through 5C). For example as illustrated in FIGS. 5B and 5C, if a viewer tips 1 token, the reward the viewer receives may be "1 second, level 1, action (e.g., vibration) of the toy. In at least some exemplary embodiments, if a viewer tips 9 tokens, the reward the viewer receives may still be "1 second, level 1, vibration of the toy."

Figure 6:
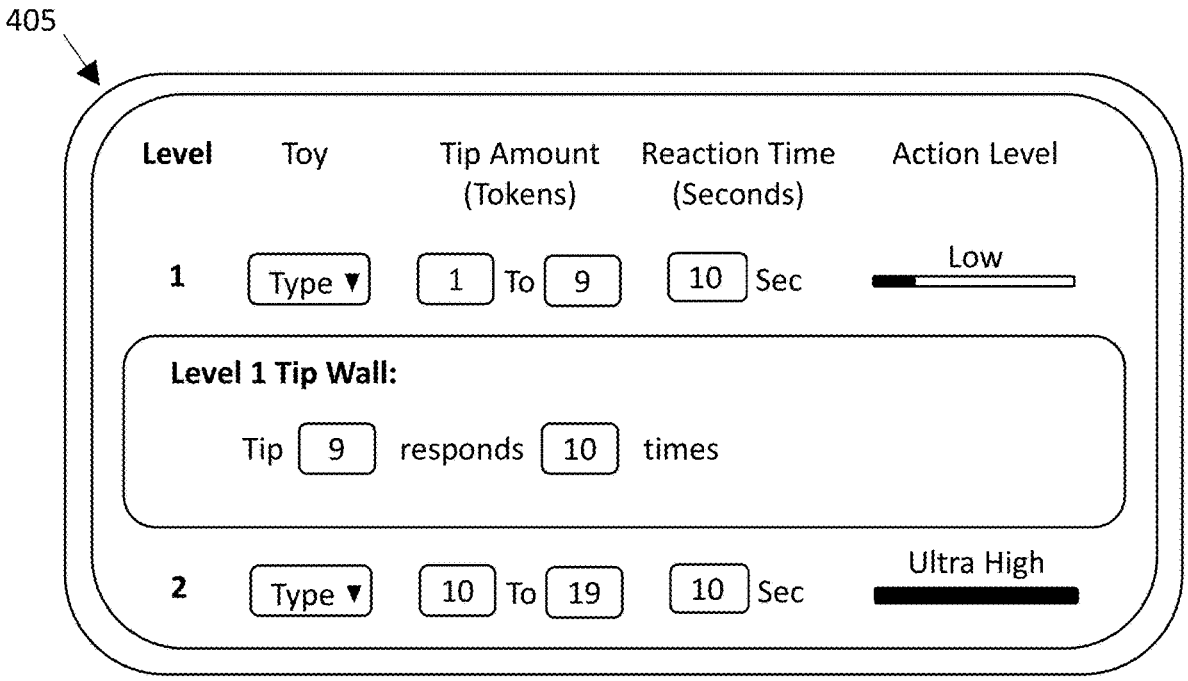
FIG. 6 is a schematic illustration of an exemplary embodiment of the exemplary disclosed system.

In another exemplary embodiment and for example as illustrated in FIG. 6, the exemplary disclosed performance optimization configuration may be performed by system 300 for the exemplary disclosed initial association to obtain the exemplary disclosed optimized association. For example, when the viewer tips the model (e.g., provides the actual tip), the viewer may obtain more rewards (e.g., several times more rewards) in the same actual tip based on the exemplary disclosed optimized association described above. For example, if a viewer tips five (5) tokens (e.g., the actual tip), system 300 may determine the actual tip to fall into a tip range [1,9] for example as illustrated in FIG. 6, and then system 300 may perform multiplexing (e.g., multiplexing 5 times of the execution parameter of 1 tokens). Therefore in this example, the viewer would receive 5 times the reward of "1 second, level 1, vibration of the toy." Similarly for example, if a viewer tips 9 tokens (e.g., the actual tip), system 300 may determine the actual tip to fall into tip range [1,9], and then perform multiplexing (e.g., multiplexing 9 times of the execution parameter of 1 tokens). Therefore in this example, the viewer would receive 9 times the reward of "1 second, level 1, vibration of the toy." The exemplary disclosed system and method may thereby increase rewards for viewers' tips based on where the tips fall within tip ranges.

In at least some exemplary embodiments, system 300 may configure one or more target values in the one or more exemplary disclosed tip ranges. System 300 may determine whether the actual tip falls within the target value in one or more exemplary disclosed tip ranges in response to receiving the actual tip from the viewer's device (e.g., male user device 305 or female user device 310). System 300 may perform the exemplary disclosed performance optimization configuration (e.g., as described above) for the initial association to obtain an optimized association according to the preconfigured weight of the target value for example as described above. Further for example, system 300 may be configured so that the viewer may obtain increased rewards when (e.g., more rewards only when) the actual tip is the maximum value within a given tip range. For example, when a target tip value preset in tip range [1,9] is 9, and when a viewer tips 9 tokens (e.g., the actual tip), system 300 may determine that the actual tip falls into tip range [1,9] and also matches the target tip value (e.g., 9). System 300 may then perform multiplexing (e.g., multiplexing 10 times of the execution parameter of 1 token). Accordingly when a viewer tips the maximum value within a tip range, the viewer may receive a relatively greater reward (e.g., 10 times the reward of "1 second, level 1, vibration of the toy"). The exemplary disclosed system and method may thereby increase the rewards for viewers' tips, and also stimulate viewers to tip at a maximum value within a tip range, thereby increasing a model's income.

Figure 7A:
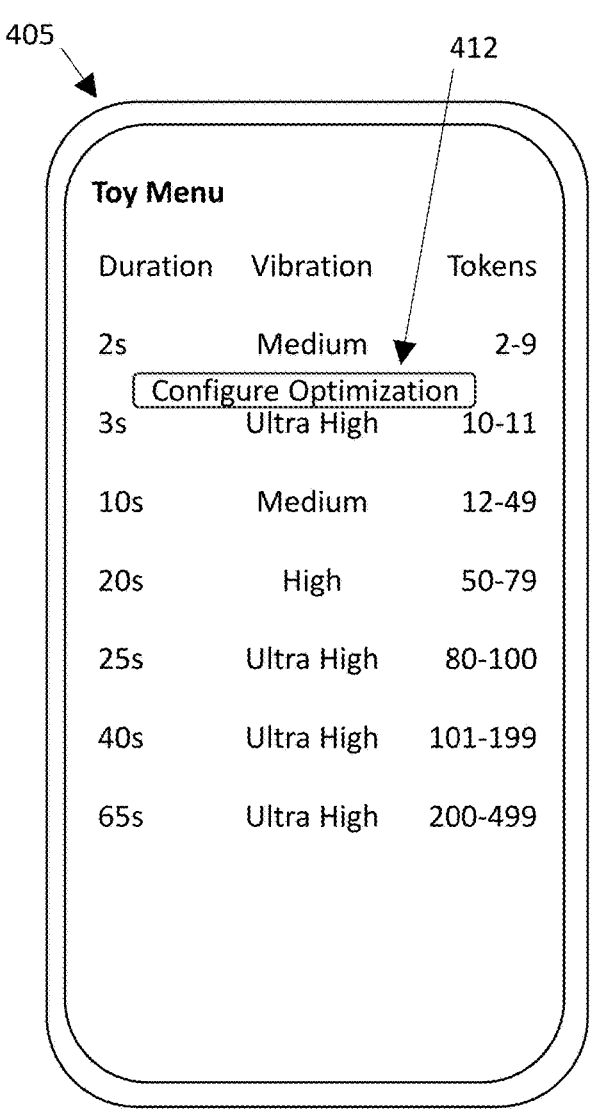
FIG. 7A is a schematic illustration of an exemplary embodiment of the exemplary disclosed system.
Figure 7B:
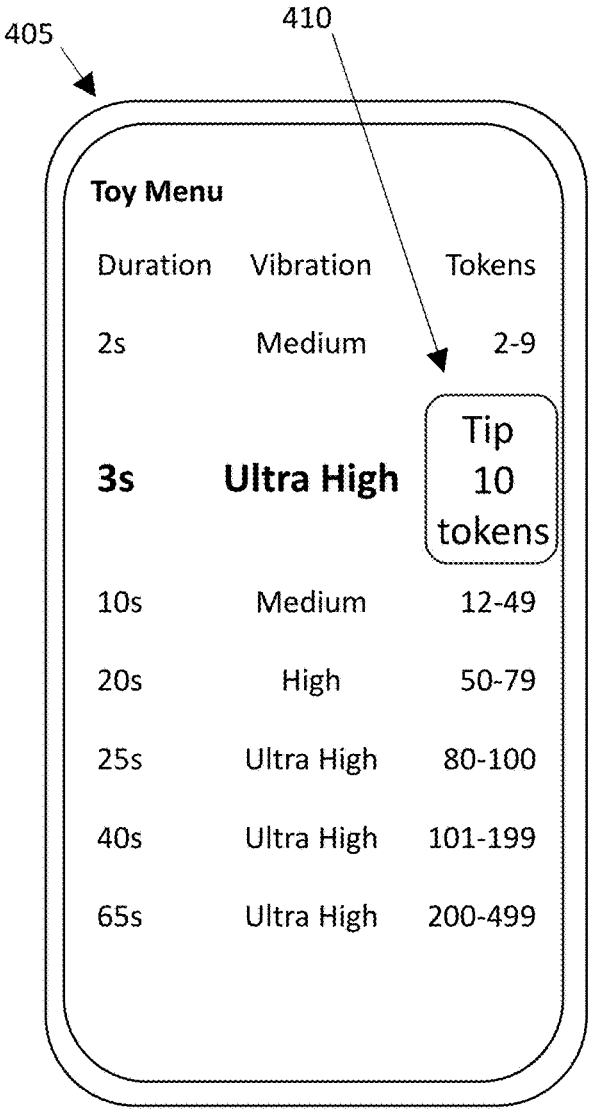
FIG. 7B is another schematic illustration of an exemplary embodiment of the exemplary disclosed system.

In at least some exemplary embodiments and as illustrated in FIGS. 7A and 7B, system 300 may configure a control element such as control element 410. Control element 410 may be any suitable graphical element that may be displayed on GUI 405. Control element 410 may be associated with a given target value corresponding to a given tip range. For example when a user (e.g., viewer) moves a cursor on (e.g., or over) or taps on GUI 405 at a reward range location, control element 410 may be rendered. For example, when activated (e.g., cursor is moved to or when tapped), GUI 405 may be altered from the display of FIG. 7A to the display of FIG. 7B. Control element 410 may be displayed in a display area of GUI 405 of the given tip range and may display the given target value of the tip range. In response to the triggering and activation of one or more control elements 410 (e.g., via being tapped) on a viewer device (e.g., male user device 305), system 300 may send the actual tip corresponding to the target value to the model device (e.g., female device 310), and may perform the exemplary disclosed performance optimization configuration for the exemplary disclosed initial association to obtain the exemplary disclosed optimized association according to a preconfigured weight of the target value for example as described above. In at least some exemplary embodiments, the exemplary disclosed actual tip remains unsplit (e.g., is not split) For example, the actual tip from the viewers (e.g., audience) may be sent from the viewer device to the model device at one time. For example as illustrated in FIGS. 7A and 7B, control element 410 may include the display of a "Tip 10 tokens" graphical element within the range of 10-11 tokens (e.g., because 10 tokens is at the lower end of the 10-11 tokens range, the adult toy may respond according to the initial action performance), which when activated may cause an actual tip of 10 tokens to remain unsplit and be sent to the model. As a further example, control element 410 may include the display of a "Tip 11 tokens" graphical element within the range of 10-11 tokens (e.g., because 11 tokens is at the upper end of the 10-11 tokens range, the adult toy may respond according to an optimized action performance that may be calculated similarly to as described herein), which when activated may cause an actual tip of 11 tokens to remain unsplit and be sent to the model. Further for example, control element 410 may include the display of a "Tip 100 tokens" graphical element within the range of 80-100 tokens (e.g., because 100 tokens is at the upper end of the 80-100 tokens range illustrated in FIGS. 7A and 7B, the adult toy may respond according to an optimized action performance that may be calculated similarly to as described herein), which when activated may cause an actual tip of 100 tokens to remain unsplit and be sent to the model. The exemplary disclosed control instructions generated based on the exemplary disclosed optimized action performance may be sent to the model device in sequence.

In at least some exemplary embodiments, system 300 may configure a target value in the exemplary disclosed tip range, and may determine whether the actual tip falls within the target value in the tip range in response to receiving the actual tip from the exemplary disclosed viewer device. If the actual tip falls within the target value, system 300 may perform the exemplary disclosed performance optimization configuration for the exemplary disclosed initial association to obtain the exemplary disclosed optimized association according to a preconfigured weight of the target value. Also for example, system 300 may configure an exemplary disclosed control element associated with the target value corresponding to the tip range. In response to the triggering of the control element, system 300 may send the actual tip corresponding to the target value to the exemplary disclosed model device, and perform the exemplary disclosed performance optimization configuration for the exemplary disclosed initial association to obtain the exemplary disclosed optimized association according to the preconfigured weight of the target value.

In at least some exemplary embodiments, system 300 may provide one or more exemplary disclosed control elements, wherein the one or more control elements may be associated with the performance optimization configuration. System 300 may perform the exemplary disclosed performance optimization configuration for the exemplary disclosed initial association to obtain the optimized association according to the weight of the actual tip in the exemplary disclosed tip range in response to triggering of the one or more control elements. Also for example, the one or more control elements may associate a predetermined tip value and a predetermined optimization configuration. In response to the triggering of the one or more control elements, the actual tip associated with the predetermined tip value may be sent to the exemplary disclosed model device. According to the weight of the actual tip in the exemplary disclosed tip range, a predetermined performance optimization configuration may be performed using the initial association. For example, one or more configuration elements (e.g., a configuration element 412 for example as illustrated in FIG. 7A) that may be generally similar to the exemplary disclosed control elements described herein may be associated with the performance optimization configuration. System 300 may perform the exemplary disclosed performance optimization configuration for the exemplary disclosed initial association to obtain the optimized association according to the weight of the actual tip in the exemplary disclosed tip range in response to triggering of configuration element 412. Configuration element 412 may be displayed when a user moves a cursor or finger (e.g., or when any other suitable control action is taken) near graphical elements depicting an initial association. For example as illustrated in FIG. 7A, configuration element 412 displaying text of "Configure Optimization" may be displayed when a control action is made near the initial association of duration of 3s at Ultra High for a range of 10-11 tokens. In at least some exemplary embodiments, configuration element 412 may be available to users who have a certain level of access and/or are subscribed to system 300 to have access for initiating the performance optimization configuration (e.g., or may be available to substantially all users). When a user triggers configuration element 412 (e.g., activates configuration element 412 similarly to as described herein regarding the exemplary disclosed control elements), system 300 may perform the exemplary disclosed performance optimization configuration (e.g., including multiplexing, geometric gain, and/or random interleaving). In at least some exemplary embodiments, activation of configuration element 412 may cause one or more of the exemplary disclosed control elements (e.g., similar to control element 410) to become active.

Figures 8, 9:
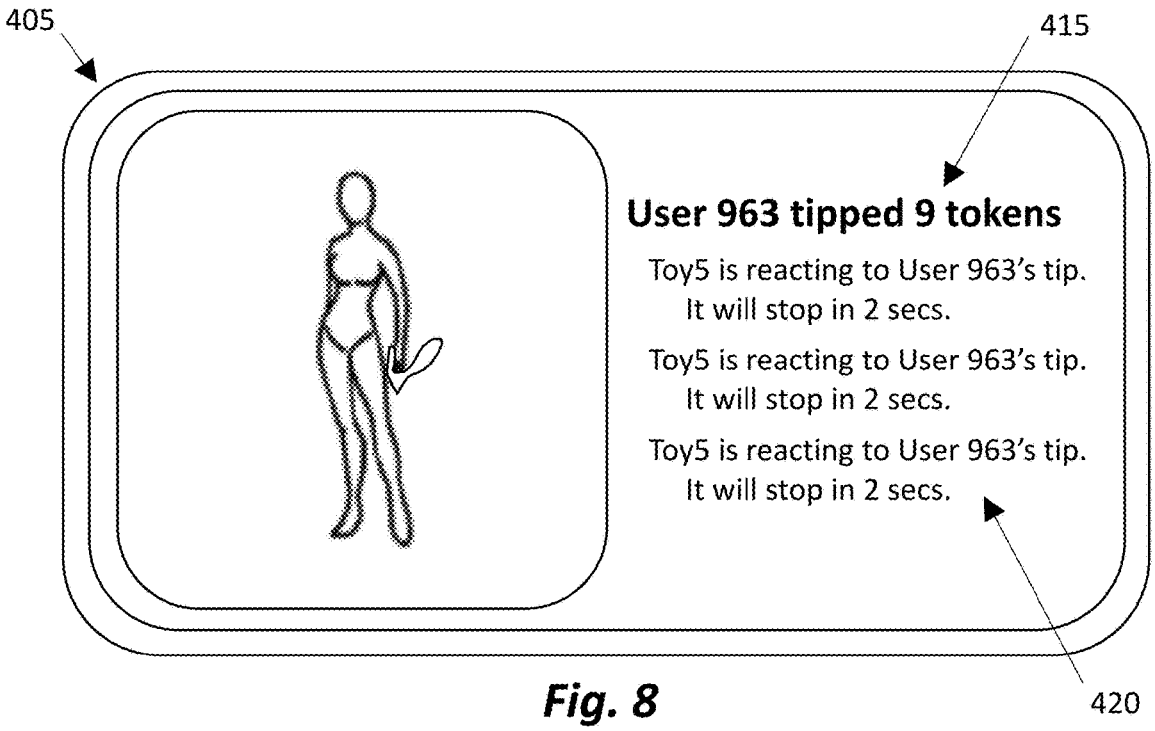
FIG. 8 is a schematic illustration of an exemplary embodiment of the exemplary disclosed system.
FIG. 9 is an illustration of exemplary tip ranges of the exemplary disclosed system.

In at least some exemplary embodiments and as illustrated in FIGS. 8 and 9, system 300 may split the exemplary disclosed actual tip (e.g., a viewer's tip or an audience's tip input) into multiple smaller tips (e.g., small amounts), with each relatively smaller tip corresponding to a reward (e.g., action of the exemplary disclosed toy). System 300 may split the actual tip (e.g., audience's tip input, for example actual tip 415 illustrated in FIG. 8) into multiple small tips based on the exemplary disclosed optimized association (e.g., optimized associations 420 illustrated in FIG. 8). Accordingly for example, the reward of one tip may be converted into the reward of multiple relatively smaller tips (e.g., small tips). For example, if a viewer tips 5 tokens as the actual tip, system 300 may determine that the actual tip falls into tip range [1,9] as illustrated in FIG. 9, and then may split the actual tip of 5 tokens into 5× (five times) 1 token (five relatively smaller tips of 1 token) to provide multiple rewards. Accordingly in this example, the viewer would receive 5 times the reward of "1 second, level 1, motion or vibration of the toy." Also for example if a viewer tips 5 tokens as the actual tip, system 300 may randomly split the 5 tokens into a 1 token tip, a 2 token tip, and a 2 token tip (e.g., or into a 3 token tip, a 1 token tip, and a 1 token tip). Accordingly for example, the viewer would receive multiple rewards of "1 second, level 1, vibration of the toy." System 300 may thereby split an actual tip so that a single viewer actual tip may result in multiple rewards.

Figure 10:
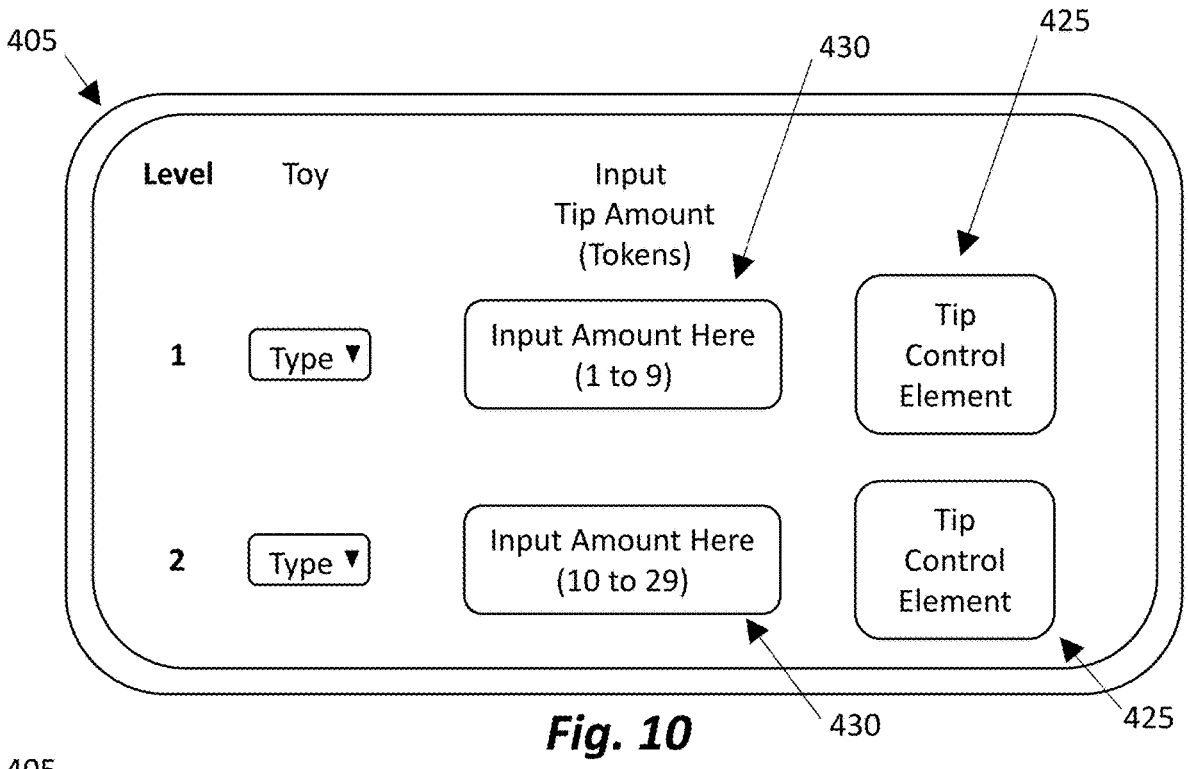
FIG. 10 is a schematic illustration of an exemplary embodiment of the exemplary disclosed system.
Figure 11:
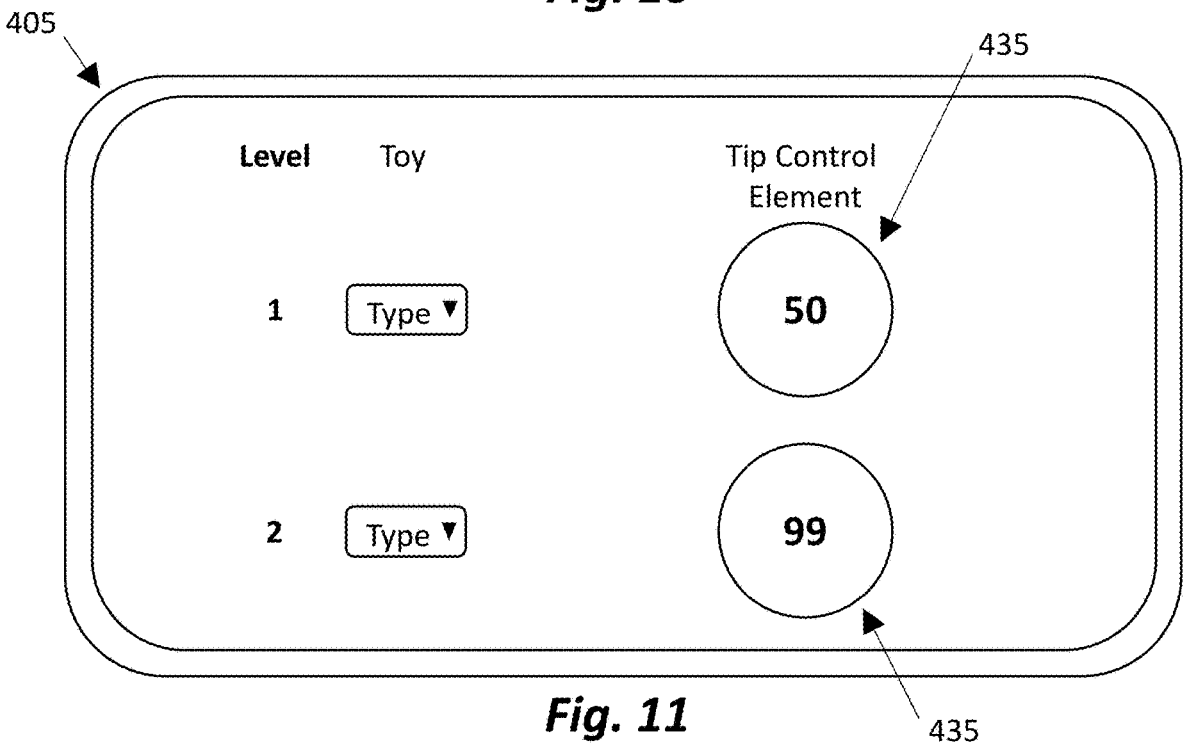
FIG. 11 is a schematic illustration of an exemplary embodiment of the exemplary disclosed system.

In at least some exemplary embodiments and as illustrated in FIGS. 10 and 11, system 300 may provide one or more control elements such as tip control elements 425 for one or more controls that may be associated with an exemplary disclosed optimization configuration. In response to the triggering of one or more tip control elements 425, system 300 may perform an exemplary disclosed performance optimization configuration for the exemplary disclosed initial association to obtain an optimized association for example as described above in response to the triggering of one or more tip control elements 425. In at least some exemplary embodiments, tip control element 425 may display an image or text that may be indicative of splitting a tip (e.g., similar to the exemplary disclosed splitting described below). Tip control elements 425 may be triggered similarly to triggering of control element 410 described above. The optimized association may be based on (e.g., performed according to) a weight of the actual tip in the exemplary disclosed tip range. For example as illustrated in FIG. 10, a viewer may input an actual tip at tip element 430 and then may trigger the corresponding tip control element 425. Tip element 430 may be a blank for number entry, a pull-down, a slidable graphical element slidable on a number range, or any other suitable input entry element. Based on this input, system 300 may split the actual tip entered at tip element 430 into multiple small tips (e.g., relatively smaller tips) and then send the multiple small tips to the exemplary disclosed model device in sequence. The actual tip may be split similarly to as described above regarding FIGS. 8 and 9. In at least some exemplary embodiments, the actual tip may be sent to the exemplary disclosed model device at one time, while the exemplary disclosed control instructions generated based on the exemplary disclosed optimized action performance may be sent to the model device in sequence.

In at least some exemplary embodiments and for example as illustrated in FIG. 11, one or more control elements 435 may associate a predetermined tip value and a predetermined exemplary disclosed optimization configuration. In response to the triggering of one or more control elements 435, an actual tip associated with the predetermined tip value may be sent to the model user (e.g., a tip of 50 or 99 for example as illustrated in FIG. 11). In at least some exemplary embodiments, control element 435 may display a target or desired tip amount (e.g., a tip amount at an upper portion of a tip range, a maximum value in a tip range, or any other desired value in a tip range). According to the weight of the actual tip in a tip range (e.g., that may also be displayed on GUI 405 similar to as shown in FIGS. 5A and 5B), a predetermined performance optimization configuration may be performed on the initial association.

Figure 12A:
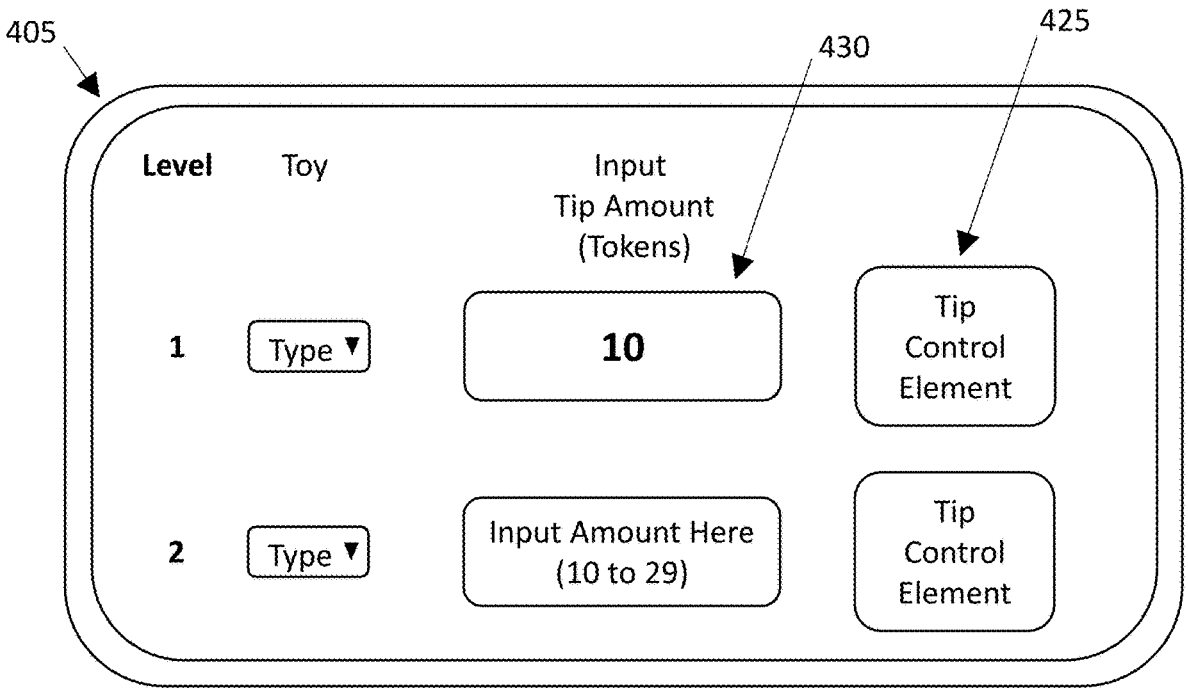
FIG. 12A is a schematic illustration of an exemplary embodiment of the exemplary disclosed system.
Figure 12B:
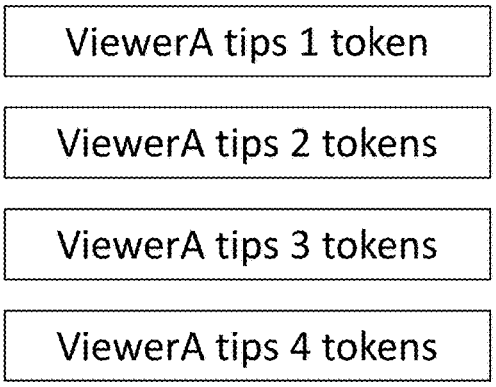
FIG. 12B is a schematic illustration of an exemplary embodiment of the exemplary disclosed system.

In at least some exemplary embodiments and for example as illustrated in FIGS. 12A and 12B, system 300 may split an actual tip into multiple small tips (e.g., relatively smaller tips), and the small tips may be automatically sent to the exemplary disclosed model device (e.g., female user device 310 or male user device 305). As illustrated in FIG. 12A, a viewer may input an actual tip and then trigger a control element. For example, a user (e.g., viewer) may input a tip amount into tip element 430 such as 10 tokens, and then may trigger tip control element 425. System 300 may split the actual tip into relatively smaller tips that may be sent to the exemplary disclosed model device in sequence. For example as illustrated in FIGS. 12A and 12B, system 300 may split an actual tip of 10 tokens into relatively smaller tips of 1 token, 2 tokens, 3 tokens, and 4 tokens that may be sent to the exemplary disclosed model device in sequence (e.g., in the order of a 1 token tip, a 2 token tip, a 3 token tip, and a 4 token tip).

Figures 13, 14:
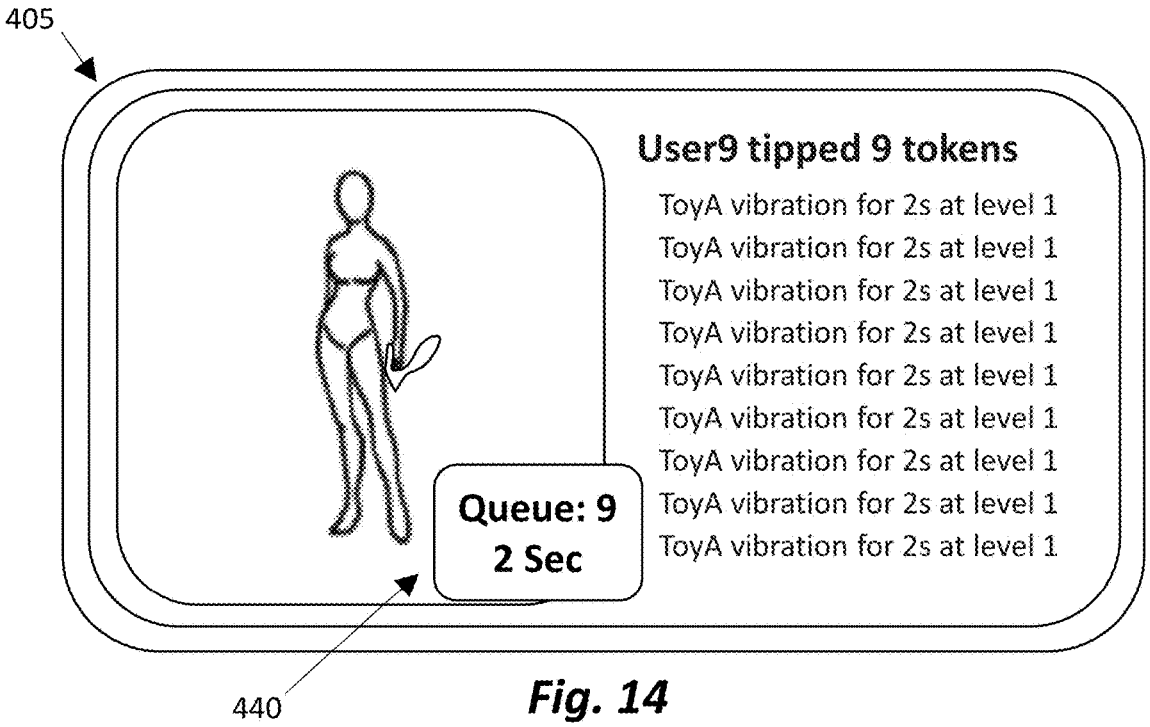
FIG. 13 is an illustration of exemplary tip ranges of the exemplary disclosed system.
FIG. 14 is a schematic illustration of an exemplary embodiment of the exemplary disclosed system.

In at least some exemplary embodiments and for example as illustrated in FIG. 13, system 300 may raise or lower a user's probability of receiving a relatively large award and/or an amount of a reward itself based on a weight of an actual tip relative to a tip range. For example, the greater the weight of tipping input (e.g., an actual tip) in a given tip range, the higher the probability of getting an increased reward and/or a relatively large reward. When receiving the actual tip from one or more viewers of the audience, system 300 may determine the tip range in which the actual tip falls for example as described above. System 300 may then perform an exemplary disclosed performance optimization configuration for the exemplary disclosed initial association to obtain the exemplary disclosed optimized reward range based on the weight of the actual tip in the tip range for example as described above. For example based on the exemplary tip ranges illustrated in FIG. 13, when the audience tips 5 tokens, the probability of getting a reward of "10 second, level 1, vibration of the toy" may be 50%, while when the audience tips 9 tokens, the probability of getting reward "10 second, level 1, vibration of the toy" may be 90%. For example, the weight of the actual tip relative to the tip range may be proportional to (e.g., positively correlated or negatively correlated to, or directly proportional or inversely proportional to) the probability of receiving an increased reward. Also for example based on the exemplary tip ranges illustrated in FIG. 13, when the audience tips 5 tokens, system 300 may provide a reward of "5 second, level 1, vibration of the toy," while when the audience tips 9 tokens, system 300 may provide a reward of "9 second, level 1, vibration of the toy" (e.g., the weight of the actual tip relative to the tip range may be positively correlated or directly proportional to the reward itself).

In at least some exemplary embodiments, system 300 may provide additional rewards based on a viewer's and/or an audience's (e.g., a plurality of viewers') cumulative (e.g., aggregate) tipping. System 300 may monitor and record (e.g., accumulate) an audience's tipping input. For example, system 300 may track tipping by a viewer, a plurality of viewers, and/or substantially all viewers of system 300 over any desired time period. When cumulative tipping for a given viewer or group of viewers reaches a preset value, system 300 may provide additional rewards to one or more viewers and/or models. The preset value may be set by system 300 (e.g., using any suitable algorithm and/or exemplary disclosed machine learning operations), a model of models using system 300, viewers, randomly, and/or via any other suitable technique. System 300 may monitor, store, track, and/or accumulate data of the audience's tipping input, and may provide an additional reward if a cumulative tip of one or more users (e.g., during a predetermined time period or an open-ended time period) accumulates to where the audience's tipping input reaches or exceeds the preset value. In at least some exemplary embodiments, the cumulative tip count may be set back to zero after additional rewards are given and accumulation may restart (e.g., the preset value may remain the same or may be adjusted downward or upward). In an exemplary embodiment, system 300 may accumulate the tip input of each individual viewer. When a given viewer's tip input reaches a preset value, system 300 may provide that viewer with an additional reward. For example, system 300 may monitor and record tipping from a plurality of viewer devices to track a cumulative tip amount, and compare the cumulative tip amount to a preset value. An additional reward may be for example an additional operation of the exemplary disclosed accessory described below at an increased intensity, operation duration, and/or operation frequency (e.g., and/or any other suitable operation attributes). In another exemplary embodiment, system 300 may accumulate a tip input from a group of viewers or substantially all (e.g., all) viewers of system 300 over a given time period (e.g., or over an open-ended time period). When the tip input from the group of viewers or all viewers reaches the preset value, system 300 may provide additional rewards to some or all of the viewers (e.g., to viewers who had tipped). For example, system 300 may provide additional rewards to viewers proportionally to how much those viewers tipped. System 300 may thereby stimulate an audience to provide an increased amount of tips.

In at least some exemplary embodiments and for example as illustrated in FIG. 14, system 300 may configure the exemplary disclosed control instructions to prompt the exemplary disclosed accessory (e.g., male accessory 308 or female accessory 315) associated with at least one of the exemplary disclosed viewer device and exemplary disclosed model device (e.g., at least one of male user device 305 and female user device 310) to respond corresponding to the exemplary disclosed optimized action performance. For example, the exemplary disclosed control instructions may be configured to control the exemplary disclosed sex toy associated with the exemplary disclosed model device (e.g., or viewer device) to perform a corresponding action (e.g., corresponding to the exemplary disclosed optimized action performance). In at least some exemplary embodiments, the exemplary disclosed control instructions may be configured to control the exemplary disclosed viewer device and/or model device to display a prompt such as a prompt 440. Prompt 440 may correspond to (e.g., be indicative of) the exemplary disclosed optimized action performance. For example as illustrated in FIG. 14, the exemplary disclosed model device or viewer device may display prompt 440 corresponding to a given optimized action performance (e.g., "Queue 9 2 sec" for 9 times the reward of 2 second, level 1, vibration of the toy).

Figure 15A:
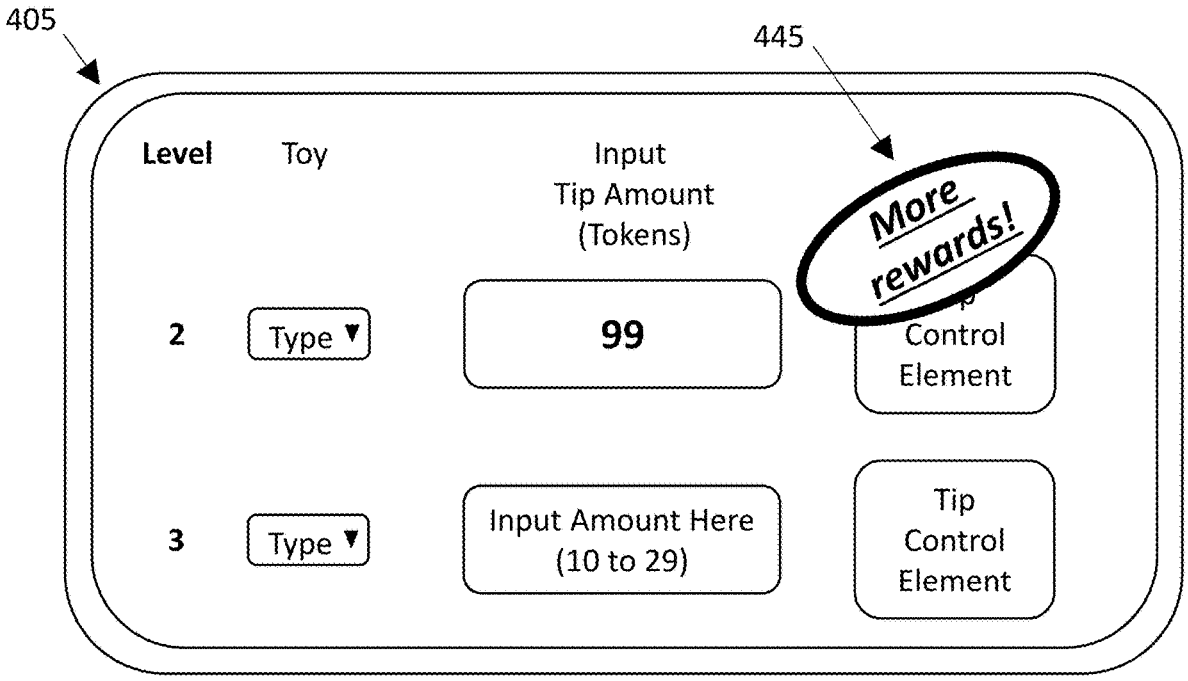
FIG. 15A is a schematic illustration of an exemplary embodiment of the exemplary disclosed system.
Figure 15B:
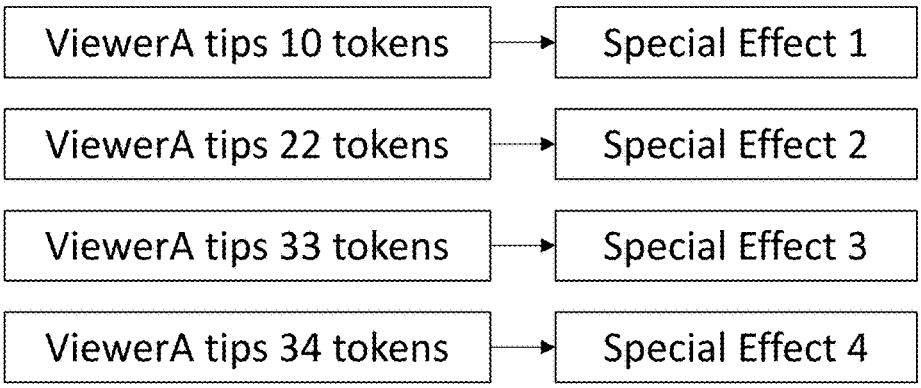
FIG. 15B is a schematic illustration of an exemplary embodiment of the exemplary disclosed system.

In at least some exemplary embodiments and for example as illustrated in FIGS. 15A and 15B, system 300 may configure the exemplary disclosed control instructions to control the exemplary disclosed viewer device (e.g., male user device 305 or female user device 310) to display one or more special effects (e.g., one or more special effects 445) corresponding to (e.g., indicative of) the exemplary disclosed optimized action performance. Special effect 445 may include animation, sound, text, tactile effects (e.g., user device vibrates), and/or any other suitable notification feature. For example, as illustrated in FIGS. 15A and 15B, the exemplary disclosed viewer device may display one or more special effects (e.g., special effect 445 associated with Special Effect 1, 2, 3, and/or 4) corresponding to the exemplary disclosed optimized action performance. For example as illustrated in FIG. 15B, an actual tip (e.g., 99 tokens) may be split into multiple small tips (e.g., relatively smaller tips) for example similar to as described above. For example, the actual tip of 99 tokens may be split into a 10 token tip (e.g., associated with Special Effect 1 that may be displayed using special effect 445), a 22 token tip (e.g., associated with Special Effect 2 that may be displayed using special effect 445), a 33 token tip (e.g., associated with Special Effect 3 that may be displayed using special effect 445), and a 34 token tip (e.g., associated with Special Effect 4 that may be displayed using special effect 445). The exemplary disclosed small tips may be sent in sequence to the exemplary disclosed model device. As each small tip is sent, the corresponding exemplary disclosed special effect may be triggered. For example, the actual tip may be sent to the model device at one time, while the control instructions generated based on the optimized action performance may be sent to the model device in sequence, with a given special effect 445 being displayed on the viewer device for each of the sequential control instructions.

In at least some exemplary embodiments, an actual tip may be split based on how tips may be provided to the model. The audience's actual tip may be divided into different types of rewards for the model. For example, the audience's tip may be split by system 300 into rewards for a model's live broadcast room and rewards for a model's wish list (e.g., or any other suitable type of rewards or compensation for the model). The actual tip may thereby be split to simultaneously control the model's exemplary disclosed one or more toys and also to help the model complete a wish list.

Figure 16:
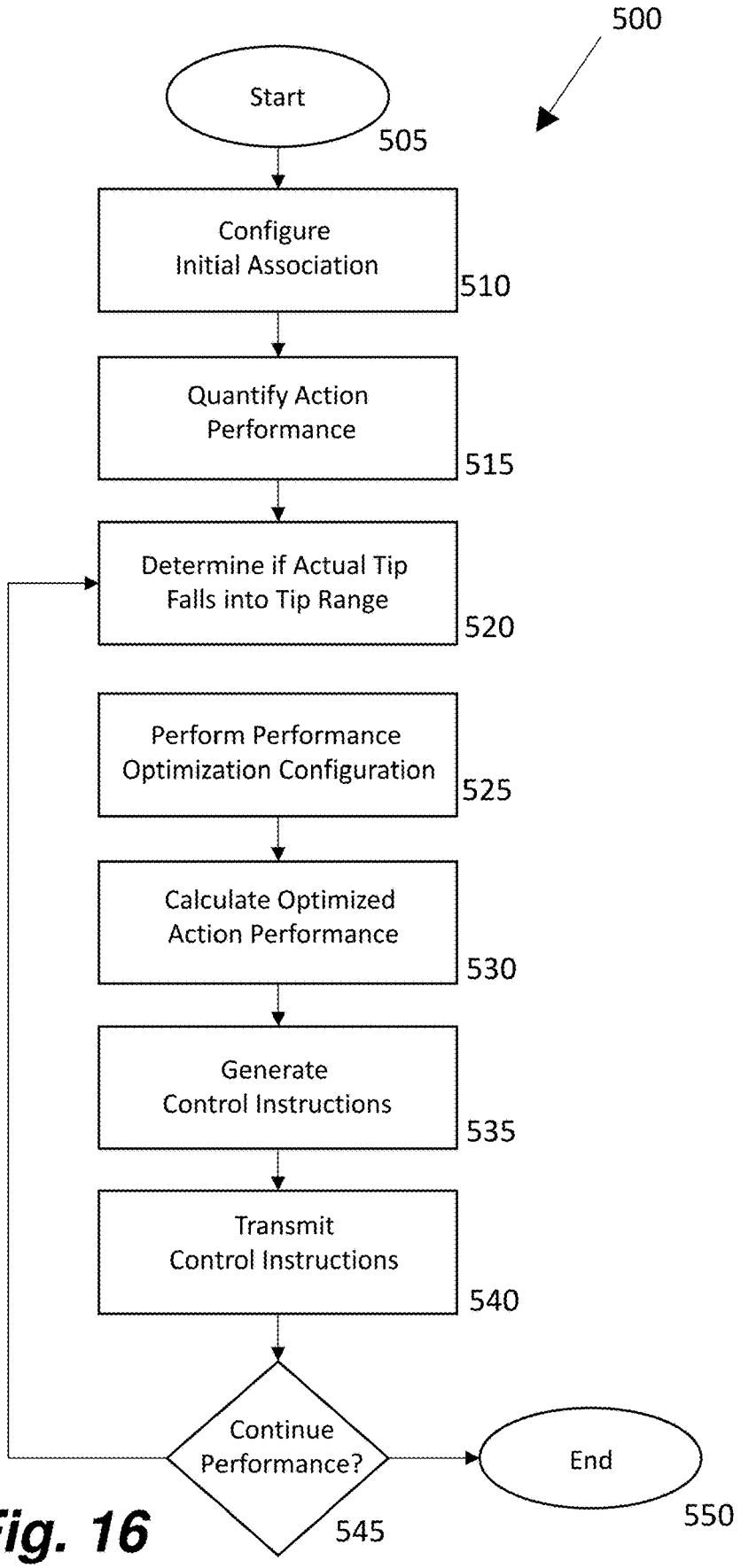
FIG. 16 is a flowchart showing an exemplary process of the present invention.

FIG. 16 illustrates an exemplary process for an operation of system 300. Process 500 begins at step 505. At step 510, system 300 may configure the exemplary disclosed initial association between the exemplary disclosed tip parameter and the exemplary disclosed execution parameter of the exemplary disclosed accessory (e.g., a toy) for example as described above.

At step 515, the exemplary disclosed action performance may be quantified by system 300 based on the exemplary disclosed execution parameter for example as described above. At step 520, system 300 may determine whether an actual tip falls into one of one or more exemplary disclosed tip ranges for example as described above.

At step 525, if an actual tip falls into one of the exemplary disclosed tip ranges, system 300 may perform an exemplary disclosed performance optimization configuration for the exemplary disclosed initial association to obtain an optimized association according to a weight of the actual tip in the tip range, for example as described above. At step 530, system 300 may calculate an optimized action performance of the exemplary disclosed accessory (e.g., toy) based on the exemplary disclosed optimized association for example as described above.

At step 535, system 300 may generate the exemplary disclosed control instructions according to the exemplary disclosed optimized action performance for example as described above. The exemplary disclosed control instructions may be configured to prompt the exemplary disclosed toy associated with the exemplary disclosed user device to respond corresponding to the exemplary disclosed optimized action performance for example as described above. At step 540, system 300 may transmit the exemplary disclosed control instructions to the exemplary disclosed user device for example as described above.

At step 545, system 300 may determine whether or not the performance (e.g., and tipping) is to be continued (e.g., based on model control or input, a predetermined time period elapsing, viewer input, machine learning operations, and/or any other suitable criteria). If the performance is to be continued, process 500 may return to step 520. As many iterations as desired of steps 520 through 545 may be performed. If the performance is not to be continued, process 500 ends at step 550.

The invention includes other illustrative embodiments ("Embodiments") as follows.

Embodiment 1: An interactive method, comprising: configuring an initial association between a tip parameter and an execution parameter of a sex toy, wherein the tip parameter includes one or more tip ranges, and the execution parameter is configured to quantify an action performance of the sex toy, wherein the execution parameter includes at least one of an action type, an action amplitude, an action duration, or an action cycle having at least one of a frequency, a start time, or an end time; determining whether an actual tip falls into one of the one or more tip ranges in response to receiving the actual tip from at least one viewer device; if the actual tip falls into the one of the one or more tip ranges, performing a performance optimization configuration for the initial association to obtain an optimized association according to a weight of the actual tip in the one of the one or more tip ranges; calculating an optimized action performance of the sex toy based on the optimized association, wherein the optimized action performance is a weight representation of at least one of the action type, the action amplitude, the action duration, and the action cycle corresponding to the one of the one or more tip ranges; generating control instructions according to the optimized action performance; and transmitting the control instructions to at least one of a model device and the at least one viewer device, wherein the model device and the at least one viewer device interact through an online platform; wherein the control instructions are configured to prompt the sex toy that is associated with the model device or the at least one viewer device to respond corresponding to the optimized action performance.

Embodiment 2: The interactive method of Embodiment 1, wherein obtaining the optimized association according to the weight of the actual tip in the one of the one or more tip ranges includes at least one of multiplexing, geometric gain, or random interleaving.

Embodiment 3: The interactive method of Embodiment 1, wherein the weight of the actual tip in the one of the one or more tip ranges is proportional to the optimized action performance of the sex toy.

Embodiment 4: The interactive method of Embodiment 1, wherein performing the performance optimization configuration for the initial association to obtain the optimized association according to the weight of the actual tip in the one of the one or more tip ranges includes: determining the one of the one or more tip ranges in which the actual tip falls and determining the execution parameter of the one of the one or more tip ranges; and calculating the weight of the actual tip and at least one of a maximum value or a minimum value of the one of the one or more tip ranges; wherein the weight of the actual tip is positively correlated or negatively correlated with the execution parameter of the one of the one or more tip ranges.

Embodiment 5: The interactive method of Embodiment 4, further comprising: obtaining the minimum value and including the minimum value as a parameter in the execution parameter; and reusing the parameter of the minimum value of the one of the one or more tip ranges to obtain the optimized association according to the weight of the actual tip in the one of the one or more tip ranges; wherein a number of reuses of the parameter of the minimum value is correlated with the weight.

Embodiment 6: The interactive method of Embodiment 1, further comprising calculating an initial action performance of the sex toy based on the actual tip and the initial association between the tip parameter and the execution parameter of the sex toy; wherein the optimized action performance of the sex toy is higher than the initial action performance of the sex toy.

Embodiment 7: The interactive method of Embodiment 1, further comprising: configuring at least one target tip range and an association between the target tip range and the optimized association; and when the actual tip received falls into the target tip range, performing the performance optimization configuration for the initial association to obtain the optimized association according to the weight of the actual tip in the target tip range.

Embodiment 8: The interactive method of Embodiment 7, further comprising: configuring a control element associated with the actual tip; and selecting a tip value from the target tip range as the actual tip in response to a triggering of the control element.

Embodiment 9: The interactive method of Embodiment 1, further comprising: configuring a target value in the one of the one or more tip ranges; determining whether the actual tip falls within the target value in the one of the one or more tip ranges in response to receiving the actual tip from the at least one viewer device; and if the actual tip falls within the target value, performing the performance optimization configuration for the initial association to obtain the optimized association according to a preconfigured weight of the target value.

Embodiment 10: The interactive method of Embodiment 9, further comprising: configuring a control element associated with the target value corresponding to the one of the one or more tip ranges; and in response to the triggering of the control element, sending the actual tip corresponding to the target value to the model device, and performing the performance optimization configuration for the initial association to obtain the optimized association according to the preconfigured weight of the target value.

Embodiment 11: The interactive method of Embodiment 1, further comprising: providing one or more control elements, wherein the one or more control elements are associated with the performance optimization configuration; and performing the performance optimization configuration for the initial association to obtain the optimized association according to the weight of the actual tip in the one of the one or more tip ranges in response to triggering of the one or more control elements.

Embodiment 12: The interactive method of Embodiment 11, wherein: the one or more control elements associate a predetermined tip value and a predetermined optimization configuration; in response to the triggering of the one or more control elements, the actual tip associated with the predetermined tip value is sent to the model device; and according to the weight of the actual tip in the one of the one or more tip ranges, a predetermined performance optimization configuration is performed using the initial association.

Embodiment 13: The interactive method of Embodiment 1, wherein the actual tip is sent to the model device at one time, while the control instructions generated based on the optimized action performance are sent to the model device in sequence.

Embodiment 14: An interactive system, comprising: at least one module comprising computer-executable code stored in non-volatile memory; and a memory for storing instructions and a processor for executing the instructions; wherein the computer-executable code, when operating on the processor, causes the system to: configure an initial association between a tip parameter and an execution parameter of a sex toy, wherein the tip parameter includes one or more tip ranges, and the execution parameter is configured to quantify an action performance of the sex toy, wherein the execution parameter includes at least one of an action type, an action amplitude, an action duration, or an action cycle having at least one of a frequency, a start time, or an end time; determine whether an actual tip falls into one of the one or more tip ranges in response to receiving the actual tip from at least one viewer device; if the actual tip falls into the one of the one or more tip ranges, perform a performance optimization configuration for the initial association to obtain an optimized association according to a weight of the actual tip in the one of the one or more tip ranges; calculate an optimized action performance of the sex toy based on the optimized association, wherein the optimized action performance is a weight representation of at least one of the action type, the action amplitude, the action duration, and the action cycle corresponding to the one of the one or more tip ranges; generate control instructions according to the optimized action performance; and transmit the control instructions to at least one of a model device and the at least one viewer device, wherein the model device and the at least one viewer device interact through an online platform; wherein the control instructions are configured to prompt the sex toy that is associated with the model device or the at least one viewer device to respond corresponding to the optimized action performance.

Embodiment 15: The interactive system of Embodiment 14, wherein obtaining the optimized association according to the weight of the actual tip in the one of the one or more tip ranges includes at least one of multiplexing, geometric gain, or random interleaving.

Embodiment 16: The interactive system of Embodiment 14, wherein the computer-executable code, when operating on the processor, causes the system to monitor and record tipping from a plurality of viewer devices to track a cumulative tip amount, and compare the cumulative tip amount to a preset value.

Embodiment 17: The interactive system of Embodiment 14, wherein performing the performance optimization configuration for the initial association to obtain the optimized association according to the weight of the actual tip in the one of the one or more tip ranges includes: determining the one of the one or more tip ranges in which the actual tip falls and determining the execution parameter of the one of the one or more tip ranges; and calculating the weight of the actual tip and at least one of a maximum value or a minimum value of the one of the one or more tip ranges; wherein the weight of the actual tip is positively correlated or negatively correlated with the execution parameter of the one of the one or more tip ranges.

Embodiment 18: A non-transitory computer-readable storage medium, comprising: machine-readable instructions, wherein the machine-readable instructions, when executed by a processor of a controller, cause the controller to: configure an initial association between a tip parameter and an execution parameter of a sex toy, wherein the tip parameter includes one or more tip ranges, and the execution parameter is configured to quantify an action performance of the sex toy, wherein the execution parameter includes at least one of an action type, an action amplitude, an action duration, or an action cycle having at least one of a frequency, a start time, or an end time; determine whether an actual tip falls into one of the one or more tip ranges in response to receiving the actual tip from at least one viewer device; if the actual tip falls into the one of the one or more tip ranges, perform a performance optimization configuration for the initial association to obtain an optimized association according to a weight of the actual tip in the one of the one or more tip ranges; calculate an optimized action performance of the sex toy based on the optimized association, wherein the optimized action performance is a weight representation of at least one of the action type, the action amplitude, the action duration, and the action cycle corresponding to the one of the one or more tip ranges; generate control instructions according to the optimized action performance; and transmit the control instructions to at least one of a model device and the at least one viewer device, wherein the model device and the at least one viewer device interact through an online platform; wherein the control instructions are configured to prompt the sex toy that is associated with the model device or the at least one viewer device to respond corresponding to the optimized action performance.

Embodiment 19: The non-transitory computer-readable storage medium of Embodiment 18, wherein the machine-readable instructions, when executed by the processor of the controller, cause the controller to: calculate an initial action performance of the sex toy based on the actual tip and the initial association between the tip parameter and the execution parameter of the sex toy; wherein the optimized action performance of the sex toy is higher than the initial action performance of the sex toy.

Embodiment 20: The non-transitory computer-readable storage medium of Embodiment 18, wherein the actual tip is sent to the model device at one time, while the control instructions generated based on the optimized action performance are sent to the model device in sequence, with a special effect being displayed on the at least one viewer device for each of the sequential control instructions.

The exemplary disclosed system and method may provide an efficient and effective technique for increasing tipping to models by viewers utilizing tipping ranges. The exemplary disclosed system and method may provide an efficient and effective technique for incentivizing viewers to tip at relatively higher portions of ranges. For example, the exemplary disclosed system and method may provide a technique to promote behavior by viewers for increasing an amount of tips paid to models during a livestream.

In at least some exemplary embodiments, the exemplary disclosed system and method may utilize sophisticated machine learning and/or artificial intelligence techniques to prepare and submit datasets and variables to cloud computing clusters and/or other analytical tools (e.g., predictive analytical tools) which may analyze such data using artificial intelligence neural networks. The exemplary disclosed system may for example include cloud computing clusters performing predictive analysis. For example, the exemplary neural network may include a plurality of input nodes that may be interconnected and/or networked with a plurality of additional and/or other processing nodes to determine a predicted result. Exemplary artificial intelligence processes may include filtering and processing datasets, processing to simplify datasets by statistically eliminating irrelevant, invariant or superfluous variables or creating new variables which are an amalgamation of a set of underlying variables, and/or processing for splitting datasets into train, test and validate datasets using at least a stratified sampling technique. The exemplary disclosed system may utilize prediction algorithms and approach that may include regression models, tree-based approaches, logistic regression, Bayesian methods, deep-learning and neural networks both as a standalone and on an ensemble basis, and final prediction may be based on the model/structure which delivers the highest degree of accuracy and stability as judged by implementation against the test and validate datasets.

Figure 17:
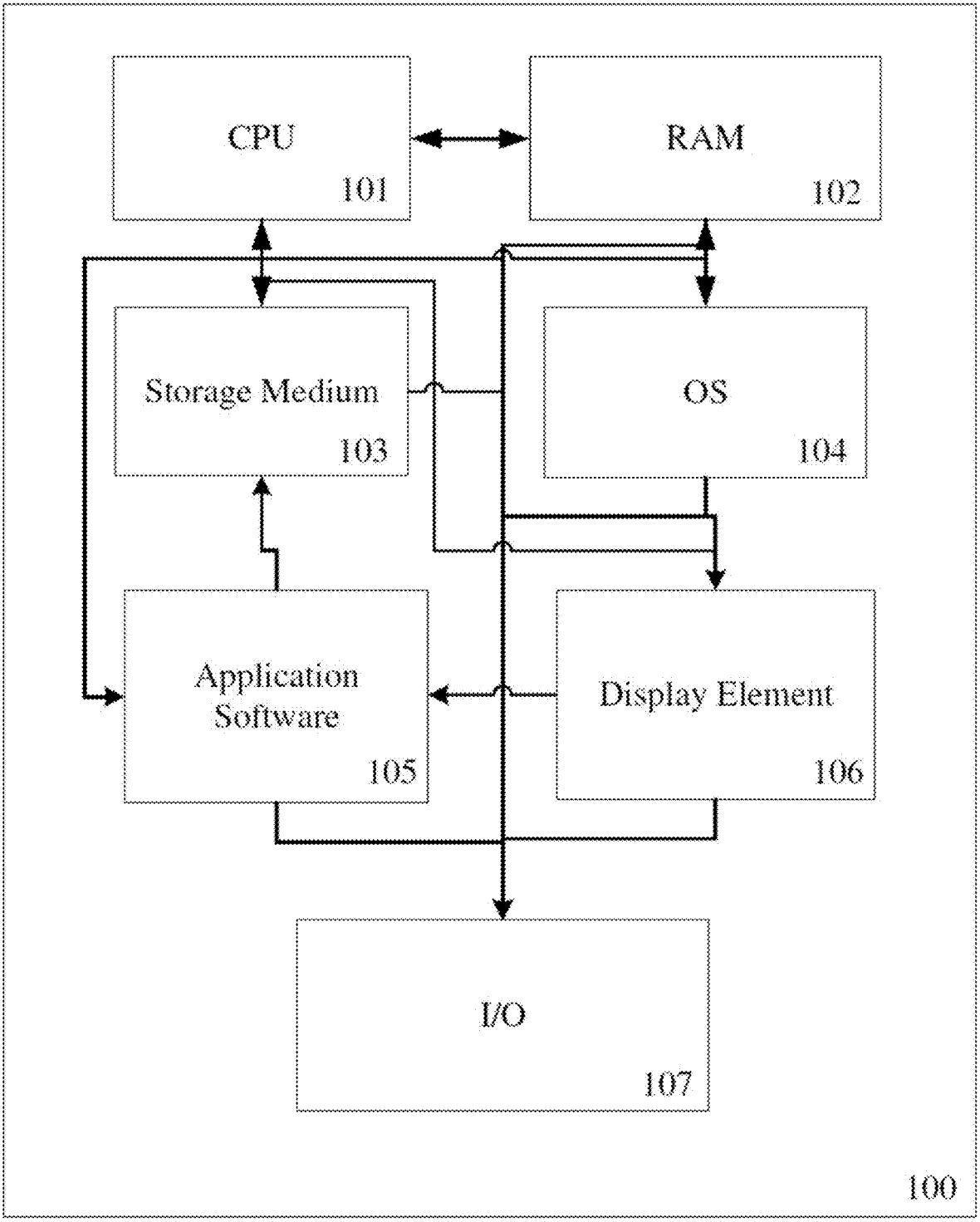
FIG. 17 is a schematic illustration of an exemplary computing device, in accordance with at least some exemplary embodiments of the present disclosure.

An illustrative representation of a computing device appropriate for use with embodiments of the system of the present disclosure is shown in FIG. 17. The computing device 100 can generally be comprised of a Central Processing Unit (CPU, 101), optional further processing units including a graphics processing unit (GPU), a Random Access Memory (RAM, 102), a mother board 103, or alternatively/additionally a storage medium (e.g., hard disk drive, solid state drive, flash memory, cloud storage), an operating system (OS, 104), one or more application software 105, a display element 106, and one or more input/output devices/means 107, including one or more communication interfaces (e.g., RS232, Ethernet, Wifi, Bluetooth, USB). Useful examples include, but are not limited to, personal computers, smart phones, laptops, mobile computing devices, tablet PCs, touch boards, and servers. Multiple computing devices can be operably linked to form a computer network in a manner as to distribute and share one or more resources, such as clustered computing devices and server banks/farms.

Various examples of such general-purpose multi-unit computer networks suitable for embodiments of the disclosure, their typical configuration and many standardized communication links are well known to one skilled in the art, as explained in more detail and illustrated by FIG. 18, which is discussed herein-below.

According to an exemplary embodiment of the present disclosure, data may be transferred to the system, stored by the system and/or transferred by the system to users of the system across local area networks (LANs) (e.g., office networks, home networks) or wide area networks (WANs) (e.g., the Internet). In accordance with the previous embodiment, the system may be comprised of numerous servers communicatively connected across one or more LANs and/or WANs. One of ordinary skill in the art would appreciate that there are numerous manners in which the system could be configured and embodiments of the present disclosure are contemplated for use with any configuration.

In general, the system and methods provided herein may be employed by a user of a computing device whether connected to a network or not. Similarly, some steps of the methods provided herein may be performed by components and modules of the system whether connected or not. While such components/modules are offline, and the data they generated will then be transmitted to the relevant other parts of the system once the offline component/module comes again online with the rest of the network (or a relevant part thereof). According to an embodiment of the present disclosure, some of the applications of the present disclosure may not be accessible when not connected to a network, however a user or a module/component of the system itself may be able to compose data offline from the remainder of the system that will be consumed by the system or its other components when the user/offline system component or module is later connected to the system network.

Figure 18:
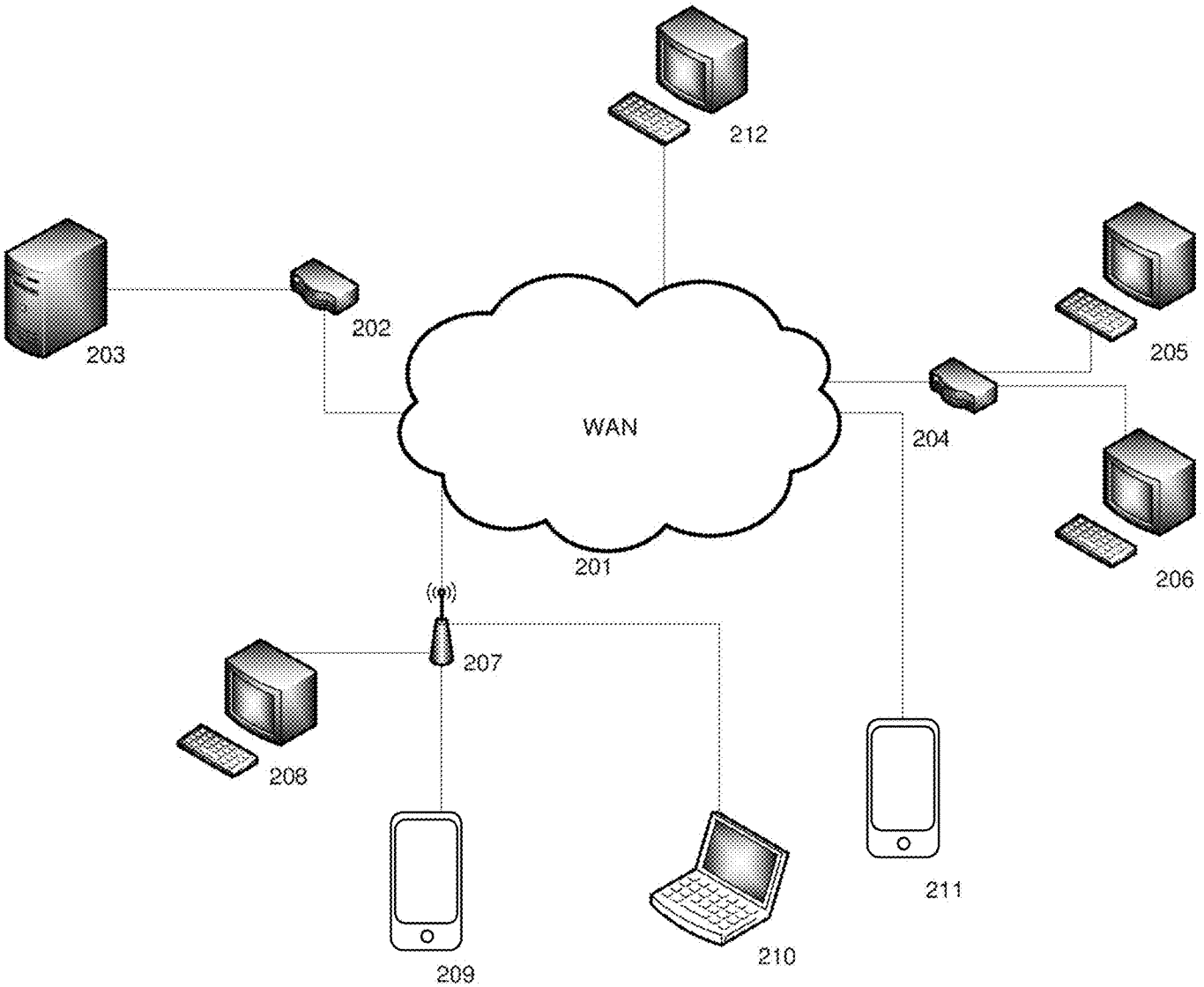
FIG. 18 is a schematic illustration of an exemplary network, in accordance with at least some exemplary embodiments of the present disclosure.

Referring to FIG. 18, a schematic overview of a system in accordance with an embodiment of the present disclosure is shown. The system is comprised of one or more application servers 203 for electronically storing information used by the system. Applications in the server 203 may retrieve and manipulate information in storage devices and exchange information through a WAN 201 (e.g., the Internet). Applications in server 203 may also be used to manipulate information stored remotely and process and analyze data stored remotely across a WAN 201 (e.g., the Internet).

According to an exemplary embodiment, as shown in FIG. 18, exchange of information through the WAN 201 or other network may occur through one or more high speed connections. In some cases, high speed connections may be over-the-air (OTA), passed through networked systems, directly connected to one or more WANs 201 or directed through one or more routers 202. Router(s) 202 are completely optional and other embodiments in accordance with the present disclosure may or may not utilize one or more routers 202. One of ordinary skill in the art would appreciate that there are numerous ways server 203 may connect to WAN 201 for the exchange of information, and embodiments of the present disclosure are contemplated for use with any method for connecting to networks for the purpose of exchanging information. Further, while this application refers to high speed connections, embodiments of the present disclosure may be utilized with connections of any speed.

Components or modules of the system may connect to server 203 via WAN 201 or other network in numerous ways. For instance, a component or module may connect to the system i) through a computing device 212 directly connected to the WAN 201, ii) through a computing device 205, 206 connected to the WAN 201 through a routing device 204, iii) through a computing device 208, 209, 210 connected to a wireless access point 207 or iv) through a computing device 211 via a wireless connection (e.g., CDMA, GMS, 3G, 4G) to the WAN 201. One of ordinary skill in the art will appreciate that there are numerous ways that a component or module may connect to server 203 via WAN 201 or other network, and embodiments of the present disclosure are contemplated for use with any method for connecting to server 203 via WAN 201 or other network. Furthermore, server 203 could be comprised of a personal computing device, such as a smartphone, acting as a host for other computing devices to connect to.

The communications means of the system may be any means for communicating data, including image and video, over one or more networks or to one or more peripheral devices attached to the system, or to a system module or component. Appropriate communications means may include, but are not limited to, wireless connections, wired connections, cellular connections, data port connections, Bluetooth® connections, near field communications (NFC) connections, or any combination thereof. One of ordinary skill in the art will appreciate that there are numerous communications means that may be utilized with embodiments of the present disclosure, and embodiments of the present disclosure are contemplated for use with any communications means.

Traditionally, a computer program includes a finite sequence of computational instructions or program instructions. It will be appreciated that a programmable apparatus or computing device can receive such a computer program and, by processing the computational instructions thereof, produce a technical effect.

A programmable apparatus or computing device includes one or more microprocessors, microcontrollers, embedded microcontrollers, programmable digital signal processors, programmable devices, programmable gate arrays, programmable array logic, memory devices, application specific integrated circuits, or the like, which can be suitably employed or configured to process computer program instructions, execute computer logic, store computer data, and so on. Throughout this disclosure and elsewhere a computing device can include any and all suitable combinations of at least one general purpose computer, special-purpose computer, programmable data processing apparatus, processor, processor architecture, and so on. It will be understood that a computing device can include a computer-readable storage medium and that this medium may be internal or external, removable and replaceable, or fixed. It will also be understood that a computing device can include a Basic Input/Output System (BIOS), firmware, an operating system, a database, or the like that can include, interface with, or support the software and hardware described herein.

Embodiments of the system as described herein are not limited to applications involving conventional computer programs or programmable apparatuses that run them. It is contemplated, for example, that embodiments of the disclosure as claimed herein could include an optical computer, quantum computer, analog computer, or the like.

Regardless of the type of computer program or computing device involved, a computer program can be loaded onto a computing device to produce a particular machine that can perform any and all of the depicted functions. This particular machine (or networked configuration thereof) provides a technique for carrying out any and all of the depicted functions.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. Illustrative examples of the computer readable storage medium may include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A data store may be comprised of one or more of a database, file storage system, relational data storage system or any other data system or structure configured to store data. The data store may be a relational database, working in conjunction with a relational database management system (RDBMS) for receiving, processing and storing data. A data store may comprise one or more databases for storing information related to the processing of moving information and estimate information as well one or more databases configured for storage and retrieval of moving information and estimate information.

Computer program instructions can be stored in a computer-readable memory capable of directing a computer or other programmable data processing apparatus to function in a particular manner. The instructions stored in the computer-readable memory constitute an article of manufacture including computer-readable instructions for implementing any and all of the depicted functions.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

The elements depicted in flowchart illustrations and block diagrams throughout the figures imply logical boundaries between the elements. However, according to software or hardware engineering practices, the depicted elements and the functions thereof may be implemented as parts of a monolithic software structure, as standalone software components or modules, or as components or modules that employ external routines, code, services, and so forth, or any combination of these. All such implementations are within the scope of the present disclosure. In view of the foregoing, it will be appreciated that elements of the block diagrams and flowchart illustrations support combinations of means for performing the specified functions, combinations of steps for performing the specified functions, program instruction technique for performing the specified functions, and so on.

It will be appreciated that computer program instructions may include computer executable code. A variety of languages for expressing computer program instructions are possible, including without limitation C, C++, Java, JavaScript, assembly language, Lisp, HTML, Perl, and so on. Such languages may include assembly languages, hardware description languages, database programming languages, functional programming languages, imperative programming languages, and so on. In some embodiments, computer program instructions can be stored, compiled, or interpreted to run on a computing device, a programmable data processing apparatus, a heterogeneous combination of processors or processor architectures, and so on. Without limitation, embodiments of the system as described herein can take the form of web-based computer software, which includes client/server software, software-as-a-service, peer-to-peer software, or the like.

In some embodiments, a computing device enables execution of computer program instructions including multiple programs or threads. The multiple programs or threads may be processed more or less simultaneously to enhance utilization of the processor and to facilitate substantially simultaneous functions. By way of implementation, any and all methods, program codes, program instructions, and the like described herein may be implemented in one or more thread. The thread can spawn other threads, which can themselves have assigned priorities associated with them. In some embodiments, a computing device can process these threads based on priority or any other order based on instructions provided in the program code.

Unless explicitly stated or otherwise clear from the context, the verbs "process" and "execute" are used interchangeably to indicate execute, process, interpret, compile, assemble, link, load, any and all combinations of the foregoing, or the like. Therefore, embodiments that process computer program instructions, computer-executable code, or the like can suitably act upon the instructions or code in any and all of the ways just described.

The functions and operations presented herein are not inherently related to any particular computing device or other apparatus. Various general-purpose systems may also be used with programs in accordance with the teachings herein, or it may prove convenient to construct more specialized apparatus to perform the required method steps. The required structure for a variety of these systems will be apparent to those of ordinary skill in the art, along with equivalent variations. In addition, embodiments of the disclosure are not described with reference to any particular programming language. It is appreciated that a variety of programming languages may be used to implement the present teachings as described herein, and any references to specific languages are provided for disclosure of enablement and best mode of embodiments of the disclosure. Embodiments of the disclosure are well suited to a wide variety of computer network systems over numerous topologies. Within this field, the configuration and management of large networks include storage devices and computing devices that are communicatively coupled to dissimilar computing and storage devices over a network, such as the Internet, also referred to as "web" or "world wide web".

Throughout this disclosure and elsewhere, block diagrams and flowchart illustrations depict methods, apparatuses (e.g., systems), and computer program products. Each element of the block diagrams and flowchart illustrations, as well as each respective combination of elements in the block diagrams and flowchart illustrations, illustrates a function of the methods, apparatuses, and computer program products. Any and all such functions ("depicted functions") can be implemented by computer program instructions; by special-purpose, hardware-based computer systems; by combinations of special purpose hardware and computer instructions; by combinations of general purpose hardware and computer instructions; and so on-any and all of which may be generally referred to herein as a "component", "module," or "system."

While the foregoing drawings and description set forth functional aspects of the disclosed systems, no particular arrangement of software for implementing these functional aspects should be inferred from these descriptions unless explicitly stated or otherwise clear from the context.

Each element in flowchart illustrations may depict a step, or group of steps, of a computer-implemented method. Further, each step may contain one or more sub-steps. For the purpose of illustration, these steps (as well as any and all other steps identified and described above) are presented in order. It will be understood that an embodiment can contain an alternate order of the steps adapted to a particular application of a technique disclosed herein. All such variations and modifications are intended to fall within the scope of this disclosure. The depiction and description of steps in any particular order is not intended to exclude embodiments having the steps in a different order, unless required by a particular application, explicitly stated, or otherwise clear from the context.

The functions, systems and methods herein described could be utilized and presented in a multitude of languages. Individual systems may be presented in one or more languages and the language may be changed with ease at any point in the process or methods described above. One of ordinary skill in the art would appreciate that there are numerous languages the system could be provided in, and embodiments of the present disclosure are contemplated for use with any language.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments.

It will be apparent to those skilled in the art that various modifications and variations can be made to the disclosed system and method. Other embodiments will be apparent to those skilled in the art from consideration of the specification and practice of the disclosed method and apparatus. It is intended that the specification and examples be considered as exemplary only, with a true scope being indicated by the following claims.

What is claimed is:

1. An interactive method, comprising:

configuring an initial association between a tip parameter and an execution parameter of a sex toy, wherein the tip parameter includes one or more tip ranges, and the execution parameter is configured to quantify an action performance of the sex toy, wherein the execution parameter includes at least one of an action type, an action amplitude, an action duration, or an action cycle having at least one of a frequency, a start time, or an end time;

determining whether an actual tip falls into one of the one or more tip ranges in response to receiving the actual tip from at least one viewer device via a processor that serves as a configuring device;

if the actual tip falls into the one of the one or more tip ranges, determining, via the configuring device, a weight value representative of a relative position of the actual tip within the one of the one or more tip ranges;

performing a performance optimization configuration for the initial association to obtain an optimized association according to the weight value via the configuring device;

calculating an optimized action performance of the sex toy based on the optimized association, wherein the optimized action performance is a weight representation of at least one of the action type, the action amplitude, the action duration, and the action cycle corresponding to the one of the one or more tip ranges;

generating control instructions according to the optimized action performance;

transmitting the control instructions to at least one of a model device and the at least one viewer device, wherein the model device and the at least one viewer device interact through an online platform; and controlling the sex toy according to the control instructions;

wherein the control instructions are configured to prompt the sex toy, which is associated with either the model device or the at least one viewer device, to respond corresponding to the optimized action performance.

2. The interactive method of claim 1, wherein obtaining the optimized association according to the weight value includes at least one of multiplexing or random interleaving.

3. The interactive method of claim 1, wherein the weight value representative of a relative position of the actual tip within the one of the one or more tip ranges is proportional to the optimized action performance of the sex toy.

4. The interactive method of claim 1, wherein performing the performance optimization configuration for the initial association to obtain the optimized association according to the weight value includes:

determining the one of the one or more tip ranges in which the actual tip falls and determining the execution parameter; and calculating a weight of the actual tip and at least one of a maximum value or a minimum value of the one of the one or more tip ranges;

wherein the weight of the actual tip is positively correlated or negatively correlated with the execution parameter.

5. The interactive method of claim 4, further comprising:

obtaining the minimum value and including the minimum value as a parameter in the execution parameter; and reusing the parameter of the minimum value of the one of the one or more tip ranges to obtain the optimized association according to the weight of the actual tip in the one of the one or more tip ranges;

wherein a number of reuses of the parameter of the minimum value is correlated with the weight.

6. The interactive method of claim 1, further comprising calculating an initial action performance of the sex toy based on the actual tip and the initial association between the tip parameter and the execution parameter of the sex toy;

wherein the optimized action performance of the sex toy is higher than the initial action performance of the sex toy.

7. The interactive method of claim 1, further comprising:

configuring at least one target tip range and an association between the at least one target tip range and the optimized association; and when the actual tip received falls into the at least one target tip range, performing the performance optimization configuration for the initial association to obtain the optimized association according to the weight value.

8. The interactive method of claim 7, further comprising:

configuring a graphical element associated with the actual tip; and selecting a tip value from the at least one target tip range as the actual tip in response to a triggering of the graphical element.

9. The interactive method of claim 1, further comprising:

configuring a target value in the one of the one or more tip ranges;

determining whether the actual tip falls within the target value in the one of the one or more tip ranges in response to receiving the actual tip from the at least one viewer device; and if the actual tip falls within the target value, performing the performance optimization configuration for the initial association to obtain the optimized association according to a preconfigured weight of the target value.

10. The interactive method of claim 9, further comprising:

configuring a graphical element associated with the target value corresponding to the one of the one or more tip ranges; and in response to a triggering of the graphical element, sending the actual tip corresponding to the target value to the model device, and performing the performance optimization configuration for the initial association to obtain the optimized association according to the preconfigured weight of the target value.

11. The interactive method of claim 1, further comprising:

providing one or more graphical elements, wherein the one or more graphical elements are associated with the performance optimization configuration; and performing the performance optimization configuration for the initial association to obtain the optimized association according to the weight value in response to triggering of the one or more graphical elements.

12. The interactive method of claim 11, wherein:

the one or more graphical elements associate a predetermined tip value and a predetermined optimization configuration;

in response to the triggering of the one or more graphical elements, the actual tip associated with the predetermined tip value is sent to the model device; and according to the weight value, a predetermined performance optimization configuration is performed using the initial association.

13. The interactive method of claim 1, wherein the actual tip is sent to the model device at one time, while the control instructions generated according to the optimized action performance are sent to the model device in sequence.

14. An interactive system, comprising:

at least one module comprising computer-executable code stored in non-volatile memory; and a memory for storing instructions and a processor for executing the instructions;

wherein the computer-executable code, when operating on the processor, causes the system to:

configure an initial association between a tip parameter and an execution parameter of a sex toy, wherein the tip parameter includes one or more tip ranges, and the execution parameter is configured to quantify an action performance of the sex toy, wherein the execution parameter includes at least one of an action type, an action amplitude, an action duration, or an action cycle having at least one of a frequency, a start time, or an end time;

determine whether an actual tip falls into one of the one or more tip ranges in response to receiving the actual tip from at least one viewer device via the processor, wherein the processor serves as a configuring device;

if the actual tip falls into the one of the one or more tip ranges, determining, via the configuring device, a weight value representative of a relative position of the actual tip within the one of the one or more tip ranges;

perform a performance optimization configuration for the initial association to obtain an optimized association according to the weight value via the configuring device;

calculate an optimized action performance of the sex toy based on the optimized association, wherein the optimized action performance is a weight representation of at least one of the action type, the action amplitude, the action duration, and the action cycle corresponding to the one of the one or more tip ranges;

generate control instructions according to the optimized action performance;

transmit the control instructions to at least one of a model device and the at least one viewer device, wherein the model device and the at least one viewer device interact through an online platform; and control the sex toy according to the control instructions;

wherein the control instructions are configured to prompt the sex toy, which is associated with either the model device or the at least one viewer device, to respond corresponding to the optimized action performance.

15. The interactive system of claim 14, wherein obtaining the optimized association according to the weight value includes at least one of multiplexing, geometric gain, or random interleaving.

16. The interactive system of claim 14, wherein the computer-executable code, when operating on the processor, causes the system to monitor and record tipping from a plurality of viewer devices to track a cumulative tip amount, and compare the cumulative tip amount to a preset value.

17. The interactive system of claim 14, wherein performing the performance optimization configuration for the initial association to obtain the optimized association according to the weight relationship includes:

determining the one of the one or more tip ranges in which the actual tip falls and determining the execution parameter; and calculating a weight of the actual tip and at least one of a maximum value or a minimum value of the one of the one or more tip ranges;

wherein the weight of the actual tip is positively correlated or negatively correlated with the execution parameter.

18. A non-transitory computer-readable storage medium, comprising:

machine-readable instructions, wherein the machine-readable instructions, when executed by a processor of a controller, cause the controller to:

configure an initial association between a tip parameter and an execution parameter of a sex toy, wherein the tip parameter includes one or more tip ranges, and the execution parameter is configured to quantify an action performance of the sex toy, wherein the execution parameter includes at least one of an action type, an action amplitude, an action duration, or an action cycle having at least one of a frequency, a start time, or an end time;

determine whether an actual tip falls into one of the one or more tip ranges in response to receiving the actual tip from at least one viewer device via the processor, wherein the processor serves as a configuring device;

if the actual tip falls into the one of the one or more tip ranges, determining, via the configuring device, a weight value representative of a relative position of the actual tip within the one of the one or more tip ranges;

perform a performance optimization configuration for the initial association to obtain an optimized association according to the weight value via the configuring device;

calculate an optimized action performance of the sex toy based on the optimized association, wherein the optimized action performance is a weight representation of at least one of the action type, the action amplitude, the action duration, and the action cycle corresponding to the one of the one or more tip ranges;

generate control instructions according to the optimized action performance;

transmit the control instructions to at least one of a model device and the at least one viewer device, wherein the model device and the at least one viewer device interact through an online platform; and control the sex toy according to the control instructions;

wherein the control instructions are configured to prompt the sex toy, which is associated with either the model device or the at least one viewer device, to respond corresponding to the optimized action performance.

19. The non-transitory computer-readable storage medium according to claim 18, wherein the machine-readable instructions, when executed by the processor of the controller, cause the controller to:

calculate an initial action performance of the sex toy based on the actual tip and the initial association between the tip parameter and the execution parameter of the sex toy;

wherein the optimized action performance of the sex toy is higher than the initial action performance of the sex toy.

20. The non-transitory computer-readable storage medium according to claim 18, wherein the actual tip is sent to the model device at one time, while the control instructions generated according to the optimized action performance are sent to the model device in sequence, with a special effect being displayed on the at least one viewer device for each of the sequential control instructions.

* * * * *